US009760029B2

(12) United States Patent
Iwashita et al.

(10) Patent No.: US 9,760,029 B2
(45) Date of Patent: Sep. 12, 2017

(54) ELECTROPHOTOGRAPHIC PHOTOSENSITIVE MEMBER, IMAGE FORMING APPARATUS, AND PROCESS CARTRIDGE

(71) Applicant: KYOCERA Document Solutions Inc., Osaka (JP)

(72) Inventors: Yuko Iwashita, Osaka (JP); Kazutaka Sugimoto, Osaka (JP); Takafumi Matsumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/007,332

(22) Filed: Jan. 27, 2016

(65) Prior Publication Data

US 2016/0223923 A1 Aug. 4, 2016

(30) Foreign Application Priority Data

Feb. 2, 2015 (JP) ..... 2015-018876

(51) Int. Cl.
*G03G 5/00* (2006.01)
*G03G 15/00* (2006.01)
*G03G 5/06* (2006.01)

(52) U.S. Cl.
CPC ..... *G03G 5/0609* (2013.01); *G03G 5/0668* (2013.01); *G03G 5/0677* (2013.01); *G03G 5/0696* (2013.01)

(58) Field of Classification Search
CPC .. G03G 5/0609; G03G 5/0696; G03G 5/0677; G03G 5/0668
See application file for complete search history.

(56) References Cited

U.S. PATENT DOCUMENTS 5,003,350 A * 3/1991 Yui ..... G03G 15/0266 399/43
5,863,688 A 1/1999 Watanabe et al.
(Continued)

FOREIGN PATENT DOCUMENTS

EP 0764886 A2 3/1997
EP 0863123 A1 9/1998
(Continued)

OTHER PUBLICATIONS

The extended European search report issued by the European Patent Office on Jun. 8, 2016, which corresponds to European Patent Application No. 16152231.3-1303 and is related to U.S. Appl. No. 15/007,332.

(Continued)

*Primary Examiner* — Thorl Chea
(74) *Attorney, Agent, or Firm* — Studebaker & Brackett PC

(57) ABSTRACT

An electrophotographic photosensitive member includes a single-layer type photosensitive layer including phthalocyanine or a derivative thereof and an electron transport material. The electron transport material includes at least one first compound represented by formula (1) or (2) shown below and at least one second compound represented by formula (3), (4), or (5) shown below. A total amount of the at least one first compound and the at least one second compound is no less than 60 parts by mass and no greater than 120 parts by mass relative to 100 parts by mass of the binder resin. An amount of the at least one first compound is no less than 35 parts by mass and no greater than 80 parts by mass. An amount of the at least one second compound is no less than 25 parts by mass and no greater than 40 parts by mass.

(Continued)

(1)

(2)

(3)

(4)

-continued (5)

10 Claims, 6 Drawing Sheets

(56) References Cited

U.S. PATENT DOCUMENTS

| | | | | |
|---|---|---|---|---|
| 5,977,389 | A | 11/1999 | Okada et al. | |
| 5,994,012 | A | 11/1999 | Watanabe et al. | |
| 6,485,873 | B1 | 11/2002 | Ohkura et al. | |
| 2014/0154619 | A1* | 6/2014 | Shimizu | G03G 5/0609 430/56 |
| 2014/0242507 | A1 | 8/2014 | Shimizu et al. | |

FOREIGN PATENT DOCUMENTS

| | | | |
|---|---|---|---|
| EP | 0879811 | A1 | 11/1998 |
| JP | 2000-314969 | A | 11/2000 |
| JP | 2007163523 | A | 6/2007 |
| JP | 2009-128882 | A | 6/2009 |
| JP | 2014-092582 | A | 5/2014 |

OTHER PUBLICATIONS

An Office Action; "Notification of Reasons for Refusal" issued by the Japanese Patent Office on Aug. 9, 2016, which corresponds to Japanese Patent Application No. 2015-018876 and is related to U.S. Appl. No. 15/007,332; with English language translation.

* cited by examiner

ELECTROPHOTOGRAPHIC PHOTOSENSITIVE MEMBER, IMAGE FORMING APPARATUS, AND PROCESS CARTRIDGE

INCORPORATION BY REFERENCE

The present application claims priority under 35 U.S.C. §119 to Japanese Patent Application No. 2015-018876, filed on Feb. 2, 2015. The contents of this application are incorporated herein by reference in their entirety.

BACKGROUND

The present disclosure relates to an electrophotographic photosensitive member, an image forming apparatus, and a process cartridge.

In recent years, image forming apparatuses have gotten both smaller and faster. In order to be compatible with a high-speed process, electrophotographic photosensitive members are desired to have higher sensitivity. Unfortunately, in a situation in which an electrophotographic photosensitive member is repeatedly used and exposed to oxidizing gas (for example, ozone or $NO_x$), sensitivity of the electrophotographic photosensitive member (more specifically, charge potential of a photosensitive layer thereof) tends to decrease.

For example, a known electrophotographic photosensitive member includes a photosensitive layer containing a specified diphenoquinone compound as an electron transport material.

SUMMARY

An electrophotographic photosensitive member according to the present disclosure includes a conductive substrate and a photosensitive layer located either directly or indirectly on the conductive substrate. The photosensitive layer is a single-layer type photosensitive layer containing at least a charge generating material, an electron transport material, a hole transport material, and a binder resin. The charge generating material contains phthalocyanine or a derivative thereof. The electron transport material includes at least one first compound represented by formula (1) or (2) shown below and at least one second compound represented by formula (3), (4), or (5) shown below. A total amount of the at least one first compound and the at least one second compound is no less than 60 parts by mass and no greater than 120 parts by mass relative to 100 parts by mass of the binder resin. An amount of the at least one first compound is no less than 35 parts by mass and no greater than 80 parts by mass. An amount of the at least one second compound is no less than 25 parts by mass and no greater than 40 parts by mass.

(1)

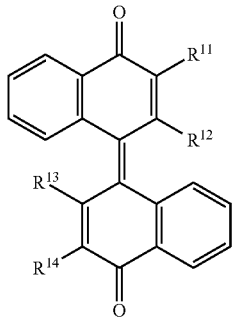

The meaning of symbols in the formula (1) is as follows. $R^{11}$, $R^{12}$, $R^{13}$, and $R^{14}$ each represent, independently of one another, a chemical group selected from the group consisting of a hydrogen atom, an optionally substituted alkyl group, an optionally substituted alkoxy group, an optionally substituted aryl group, and an optionally substituted aralkyl group.

(2)

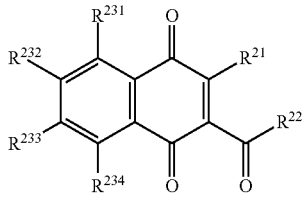

The meaning of symbols in the formula (2) is as follows. $R^{21}$ represents an optionally substituted alkyl group or an optionally substituted aryl group. $R^{22}$ represents an optionally substituted alkyl group, an optionally substituted aryl group, or a chemical group represented by formula —O—X in which X represents an optionally substituted alkyl group, an optionally substituted aryl group, or an optionally substituted aralkyl group. $R^{231}$ to $R^{234}$ each represent, independently of one another, a hydrogen atom or an optionally substituted alkyl group. $R^{21}$, $R^{22}$, and $R^{231}$ to $R^{234}$ may be the same as or different from one another.

(3)

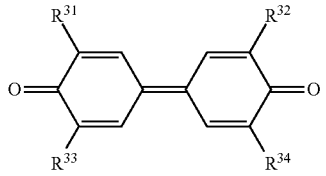

(4)

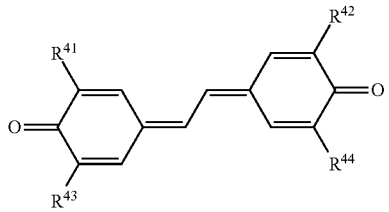

(5)

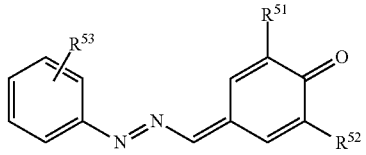

The meaning of symbols in the formulae (3), (4), and (5) is as follows. $R^{31}$, $R^{32}$, $R^{33}$, $R^{34}$, $R^{41}$, $R^{42}$, $R^{43}$, $R^{44}$, $R^{51}$, and $R^{52}$ each represent, independently of one another, a chemical group selected from the group consisting of a hydrogen atom, an optionally substituted alkyl group, an optionally substituted alkenyl group, an optionally substituted alkoxy group, an optionally substituted aryl group, an optionally substituted aralkyl group, and an optionally substituted heterocyclic group. $R^{53}$ represents a chemical group selected from the group consisting of a hydrogen atom, a halogen atom, an optionally substituted alkyl group, an optionally substituted alkenyl group, an optionally substituted alkoxy group, an optionally substituted aryl group, an optionally substituted aralkyl group, and an optionally substituted heterocyclic group.

An image forming apparatus according to the present disclosure includes an image bearing member, a charger, a light exposure section, a development section, and a transfer section. The image bearing member includes the electrophotographic photosensitive member according to the present disclosure.

A process cartridge according to the present disclosure includes the electrophotographic photosensitive member according to the present disclosure.

DETAILED DESCRIPTION

Figure 1A:
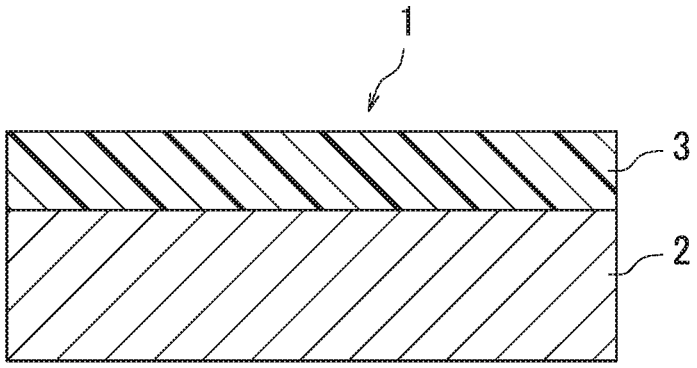
FIGS. 1A, 1B, and 1C are cross-sectional views each illustrating an overview of an electrophotographic photosensitive member according to an embodiment of the present disclosure.

Hereinafter, an embodiment of the present disclosure will be described. A photosensitive member according to the present embodiment is an electrophotographic photosensitive member. The photosensitive member according to the present embodiment includes a conductive substrate and a photosensitive layer. The photosensitive layer is located either directly or indirectly on the conductive substrate. The photosensitive layer is a single-layer type photosensitive layer including at least a charge generating material, an electron transport material, a hole transport material, and a binder resin. The charge generating material in the photosensitive layer contains phthalocyanine or a derivative thereof. The electron transport material in the photosensitive layer contains at least one compound represented by the formula (1) or (2) shown above (hereinafter, referred to as ETM1) and at least one compound represented by the formula (3), (4), or (5) shown above (hereinafter, referred to as ETM2). A total amount of ETM1 and ETM2 is no less than 60 parts by mass and no greater than 120 parts by mass relative to 100 parts by mass of the binder resin, in which an amount of ETM1 (a total amount in a configuration including a plurality of ETM1) is no less than 35 parts by mass and no greater than 80 parts by mass, and an amount of ETM2 (a total amount in a configuration including a plurality of ETM2) is no less than 25 parts by mass and no greater than 40 parts by mass.

More specifically, increasing the amount of the electron transport material in the photosensitive layer tends to increase a chance of contact between the charge generating material and the electron transport material or a chance of presence of the charge generating material in the vicinity of the electron transport material, facilitating charges generated by light exposure to be swiftly transported to a surface of the photosensitive layer. Furthermore, facilitating the charge transport in the photosensitive layer tends to improve repeated use resistance of the photosensitive member and restrict image memory in light exposure and image transfer. However, in a situation in which the charge generating material in the photosensitive layer contains phthalocyanine or a derivative thereof, increasing too much the amount of the electron transport material in the photosensitive layer tends to cause formation of a fine crystalline structure resulting from the electron transport material in the photosensitive layer. Formation of such a crystalline structure tends to result in reduction in sensitivity of the photosensitive layer and reduction in charge retention rate of the photosensitive layer, leading to reduction in surface potential of the photosensitive layer. The inventors have found that an electrophotographic photosensitive member having excellent environment resistance (more specifically, resistance to oxidizing gas) and excellent repeated use resistance is achieved as a result of including at least one ETM1 in an amount as specified above and at least one ETM2 in an amount as specified above in a photosensitive layer (see Tables 1 and 2 below). Use of phthalocyanine or a derivative thereof in the charge generating material and use of ETM1 and ETM2 in the electron transport material are effective for improving the charge retention rate of the photosensitive layer. Furthermore, the above-mentioned crystallization can be restricted by adjusting the amount of ETM1 and the amount of ETM2 within the above-specified ranges. In the photosensitive member having the above-described configuration, surface potential of the photosensitive layer is not easily reduced even if the photosensitive member is used while being exposed to oxidizing gas (for example, ozone or NOx) or even if the photosensitive member is subjected to alternately repeated charging and light exposure.

Figure 1B:
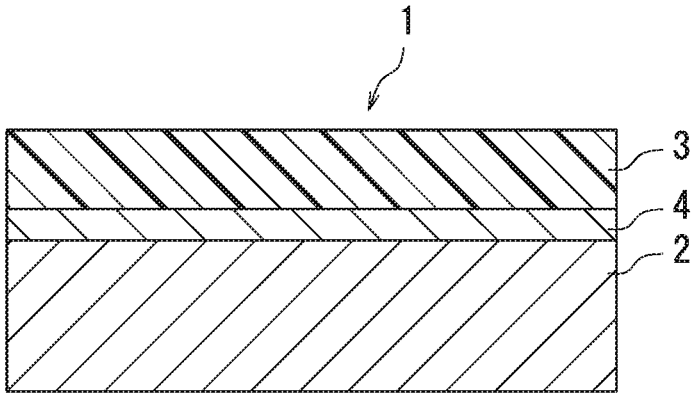
Figure 1C:
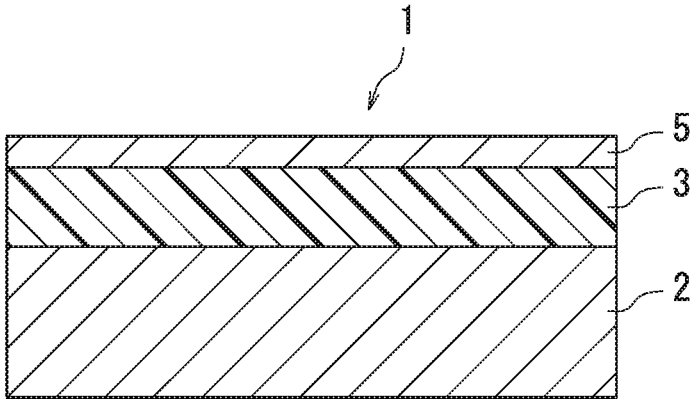

Hereinafter, general structure of the photosensitive member of the present embodiment will be described with reference to FIGS. 1A to 1C. As illustrated in FIGS. 1A to 1C, a photosensitive member 1 includes a conductive substrate 2 and a photosensitive layer 3. In an example illustrated in FIG. 1A, the photosensitive layer 3 is disposed directly on the substrate 2. In an example illustrated in FIG. 1B, the photosensitive layer 3 is disposed indirectly on the substrate 2. More specifically, an undercoat layer 4 (intermediate layer) is disposed between the substrate 2 and the photosensitive layer 3. The photosensitive layer 3 may be exposed as an outermost layer as illustrated in FIGS. 1A and 1B. Alternatively, a protective layer 5 may be provided on the photosensitive layer 3 as illustrated in FIG. 1C.

[Conductive Substrate]

The photosensitive member according to the present embodiment includes a conductive substrate. The conductive substrate may be sheet-shaped or drum-shaped. Shape and dimensions of the conductive substrate is preferably determined in accordance with the structure of an image forming apparatus in which the conductive substrate is to be used.

At least a surface portion of the conductive substrate is conductive. Either the whole of the conductive substrate is formed from a conductive material or only the surface portion of the conductive substrate is formed from a conductive material. For example, only the surface portion of the conductive substrate may be formed from a conductive material, and a non-surface portion may be formed from a non-conductive material (for example, plastic). Examples of preferable conductive materials include aluminum, iron, copper, tin, platinum, silver, vanadium, molybdenum, chromium, cadmium, titanium, nickel, palladium, indium, stainless steel, and brass, and alloys of these metals. Preferably, at least the surface portion of the conductive substrate is formed from aluminum or an aluminum alloy in order to promote charge transfer from the photosensitive layer to the conductive substrate.

[Intermediate Layer]

The photosensitive member according to the present embodiment may include an intermediate layer (for example, an undercoat layer 4 illustrated in FIG. 1B) between the conductive substrate and the photosensitive layer. The intermediate layer is for example used to facilitate flow of current generated when the photosensitive member is exposed to light, while also maintaining insulation to a sufficient degree so as to inhibit leakage current from occurring.

The intermediate layer for example contains a resin and inorganic particles dispersed in the resin. Examples of inorganic particles that may be contained in the intermediate layer includes particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used independently, or two or more types thereof may be used in a combination.

[Photosensitive Layer]

The photosensitive member according to the present embodiment includes a photosensitive layer. The photosensitive layer contains at least a charge generating material, an electron transport material, a hole transport material, and a binder resin. The photosensitive layer may contain an additive as needed.

In order that the photosensitive layer has high sensitivity in a stable manner, the photosensitive layer preferably has a thickness of no less than 5 μm and no greater than 100 μm, and more preferably no less than 10 μm and no greater than 50 μm.

(Charge Generating Material)

The charge generating material in the photosensitive layer contains at least one phthalocyanine or derivative thereof. Examples of the phthalocyanine that can be favorably used include X-form metal-free phthalocyanine represented by formula (x-$H_2$Pc) shown below. Examples of phthalocyanine derivatives that can be preferably used include titanyl phthalocyanine represented by formula (TiOPc) shown below. The titanyl phthalocyanine represented by the formula (TiOPc) may have a substituent in a benzene ring thereof. The titanyl phthalocyanine represented by the formula (TiOPc) may have one or more substituents. In a structure including a plurality of substituents, the substituents may be of the same type or of different types. Preferably, the titanyl phthalocyanine has one or more substituents selected from the group consisting of a halogen atom (more preferably, fluorine, chlorine, bromine, and iodine), an alkyl group having a carbon number of no less than 1 and no greater than 12 (more preferably, an alkyl group having a carbon number of no less than 1 and no greater than 6), a cyano group, and a nitro group. Note that the charge generating material is not limited to the charge generating materials listed above. For example, a phthalocyanine derivative such as phthalocyanine in which a metal other than titanium oxide is coordinated (for example, v-form hydroxygallium phthalocyanine) may be used as a charge generating material. The photosensitive layer may contain another charge generating material that is not phthalocyanine or a phthalocyanine derivative in addition to the phthalocyanine.

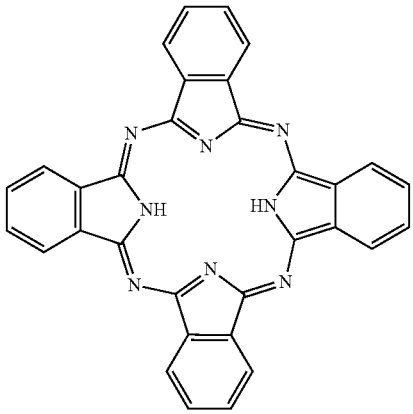

($H_2$Pc)

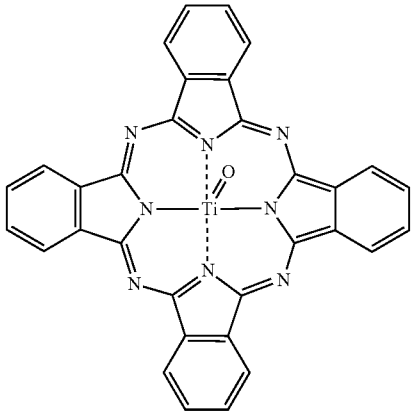

(TiOPc)

The crystal form of the titanyl phthalocyanine contained in the photosensitive layer may be any of Y, α, and β. Furthermore, the charge generating material in the photosensitive layer may include a plurality of different types of titanyl phthalocyanine crystals that have different crystal forms relative to one another. In order that the photosensitive layer has excellent electrical properties in a stable manner, the photosensitive layer preferably contains Y-form titanyl phthalocyanine crystals exhibiting a main peak at a Bragg angle (2θ±0.2°) of 27.2° in a CuKα characteristic X-ray diffraction spectrum. The term main peak refers to a most intense or second most intense peak within a range of Bragg angles (2θ±0.2) from 3° C. to 40° in a CuKα characteristic X-ray diffraction spectrum.

The Y-form titanyl phthalocyanine crystals exhibiting the above-described characteristic (main peak: 27.2°) with respect to the X-ray diffraction are classified into three types based on a difference in thermal characteristics measured by differential scanning calorimetry (DSC) (more specifically, thermal characteristics (A) to (C) shown below).

(A) In a thermal characteristic measured by DSC, at least one peak is present in a range from 50° C. to 270° C. other than a peak resulting from vaporization of absorbed water.

(B) In a thermal characteristic measured by DSC, a peak is not present in a range from 50° C. to 400° C. other than a peak resulting from vaporization of absorbed water.

(C) In a thermal characteristic measured by DSC, a peak is not present in a range from 50° C. to 270° C. other than a peak resulting from vaporization of absorbed water and at least one peak is present in a range from 270° C. to 400° C.

Of the Y-form titanyl phthalocyanine crystals exhibiting the above-described characteristic (main peak: 27.2°) with respect to the X-ray diffraction. Y-form titanyl phthalocyanine crystals having the thermal characteristic (A) are referred to as "Y-form titanyl phthalocyanine (A)", Y-form titanyl phthalocyanine crystals having the thermal characteristic (B) are referred to as "Y-form titanyl phthalocyanine (B)", and Y-form titanyl phthalocyanine crystals having the thermal characteristic (C) are referred to as "Y-form titanyl phthalocyanine (C)".

The Y-form titanyl phthalocyanines (A) to (C) are thought to each have a high quantum yield for a wavelength region of 700 nm or greater and excellent charge generating ability.

The Y-form titanyl phthalocyanines (B) and (C) each have excellent crystal stability, are resistant to crystal dislocation in an organic solvent, and are readily dispersible in a photosensitive layer.

<CuKα Characteristic X-Ray Diffraction Spectrum>

The crystal structure of titanyl phthalocyanine can be inferred based on its optical properties (for example, CuKα characteristic X-ray diffraction spectrum). An example of a method for measuring the CuKα characteristic X-ray diffraction spectrum is explained below.

A sample (titanyl phthalocyanine crystals) is loaded into a sample holder of an X-ray diffraction spectrometer (for example, "RINT (registered Japanese trademark) 1100", product of Rigaku Corporation) and an X-ray diffraction spectrum is measured using a Cu X-ray tube, a tube voltage of 40 kV, a tube current of 30 mA, and X-rays characteristic of CuKα having a wavelength of 1.542 Å. The measurement range (2θ) is for example from 3° to 40° (start angle: 3°, stop angle: 40°) and the scanning speed is for example 10/minute.

Y-form titanyl phthalocyanine crystals exhibit a main peak at a Bragg angle (2θ±0.2° C.) of 27.2° in a CuKα characteristic X-ray diffraction spectrum. In contrast, α-form titanyl phthalocyanine crystals exhibit a peak at a Bragg angle (2θ±0.2° C.) of 28.6° in a CuKα characteristic X-ray diffraction spectrum. Furthermore, n-form titanyl phthalocyanine crystals exhibit a peak at a Bragg angle (2θ±0.2°) of 26.2° in a CuKα characteristic X-ray diffraction spectrum.

<Differential Scanning Calorimetry Spectrum>

The Crystal structure of titanyl phthalocyanine can be inferred based on its thermal properties (for example, differential scanning calorimetry spectrum). An example of a method for measuring the differential scanning calorimetry spectrum is explained below.

An evaluation sample of a crystal powder is loaded into a sample pan and a differential scanning calorimetry spectrum is measured using a differential scanning calorimeter (for example, "Model TAS-200, DSC8230D", product of Rigaku Corporation). The measurement range is for example from 40° to 400° and the heating rate is for example 20° C./minute.

The Y-form titanyl phthalocyanine (B) does not exhibit a peak in a range from 50° C. to 400° C. other than a peak resulting from vaporization of absorbed water in a differential scanning calorimetry spectrum.

The Y-form titanyl phthalocyanine (C) does not exhibit a peak in a range from 50° C. to 270° C. other than a peak resulting from vaporization of absorbed water and exhibits a peak in a range from 270° C. to 400° C. in a differential scanning calorimetry spectrum.

Figure 2:
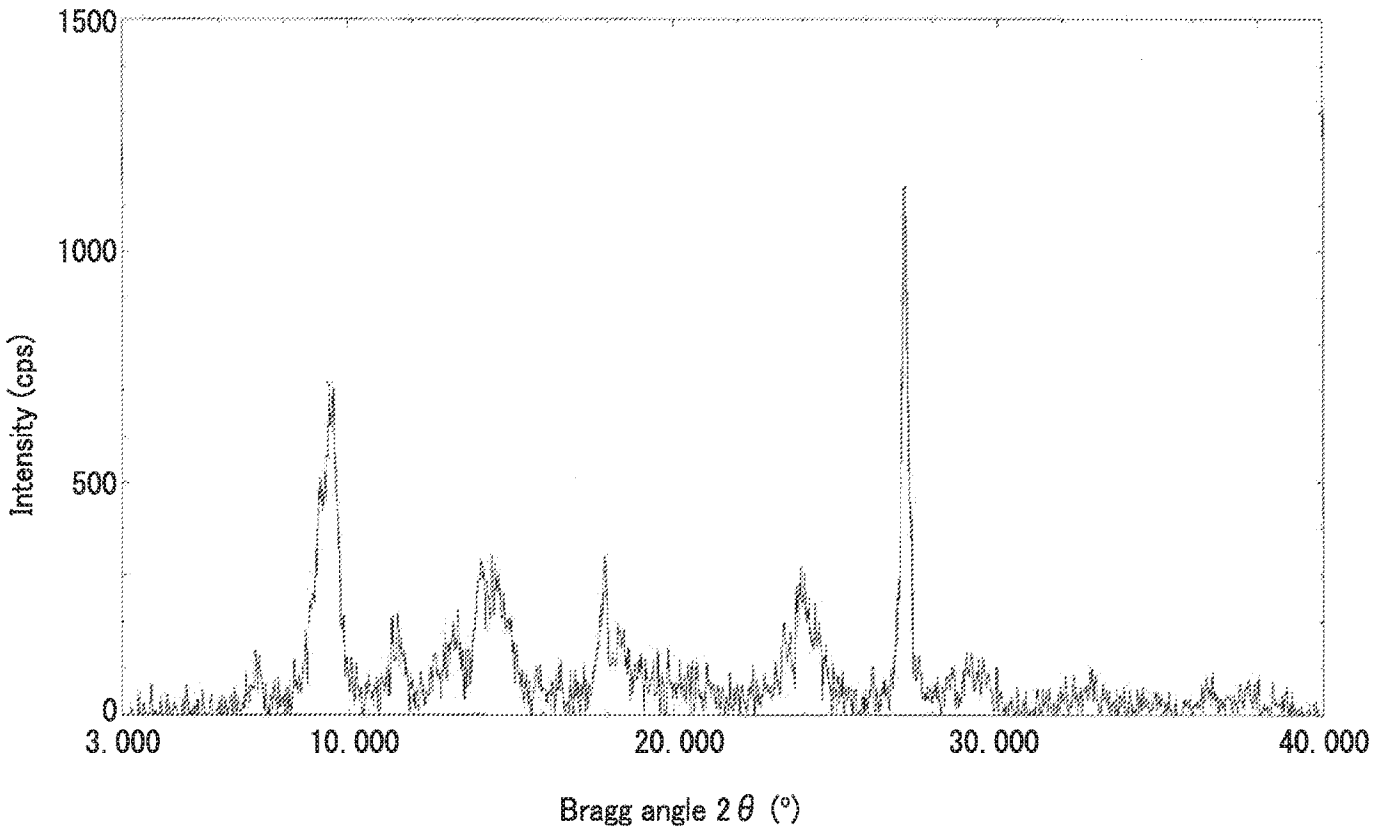
FIG. 2 is a CuKα characteristic X-ray diffraction spectral chart for a first example of titanyl phthalocyanine used in the electrophotographic photosensitive member according to the embodiment of the present disclosure.
Figure 3:
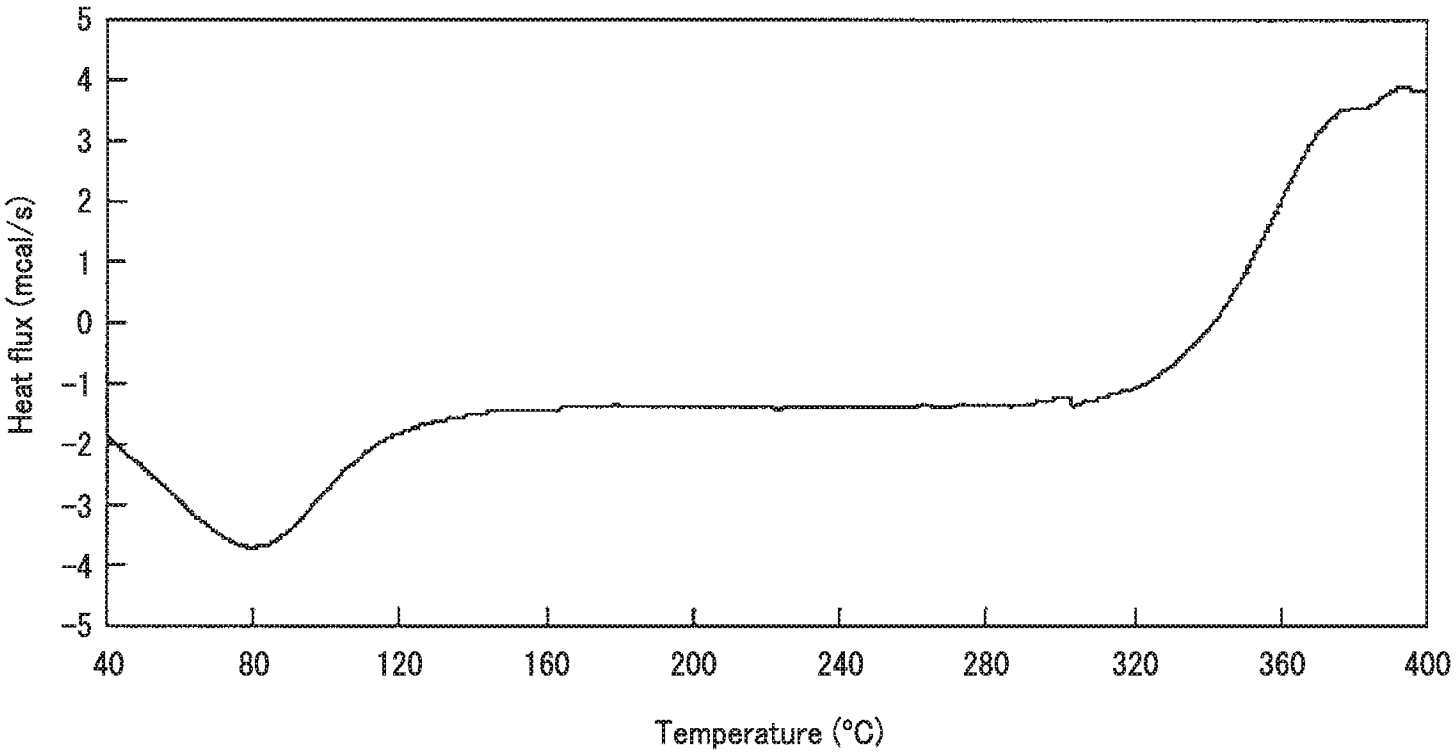
FIG. 3 is a differential scanning calorimetry spectral chart for the first example of titanyl phthalocyanine used in the electrophotographic photosensitive member according to the embodiment of the present disclosure.
Figure 4:
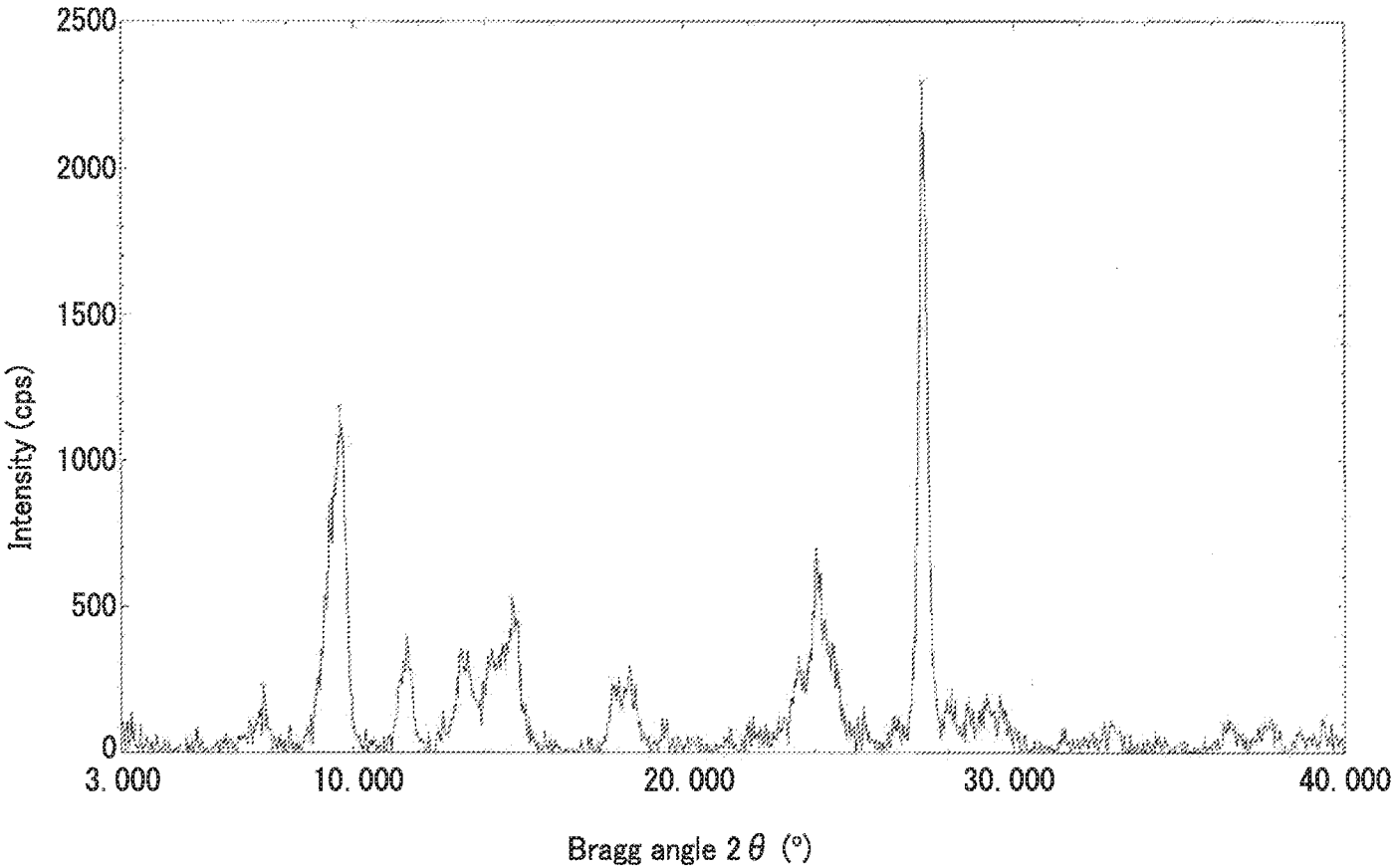
FIG. 4 is a CuKα characteristic X-ray diffraction spectral chart for a second example of titanyl phthalocyanine used in the electrophotographic photosensitive member according to the embodiment of the present disclosure.
Figure 5:
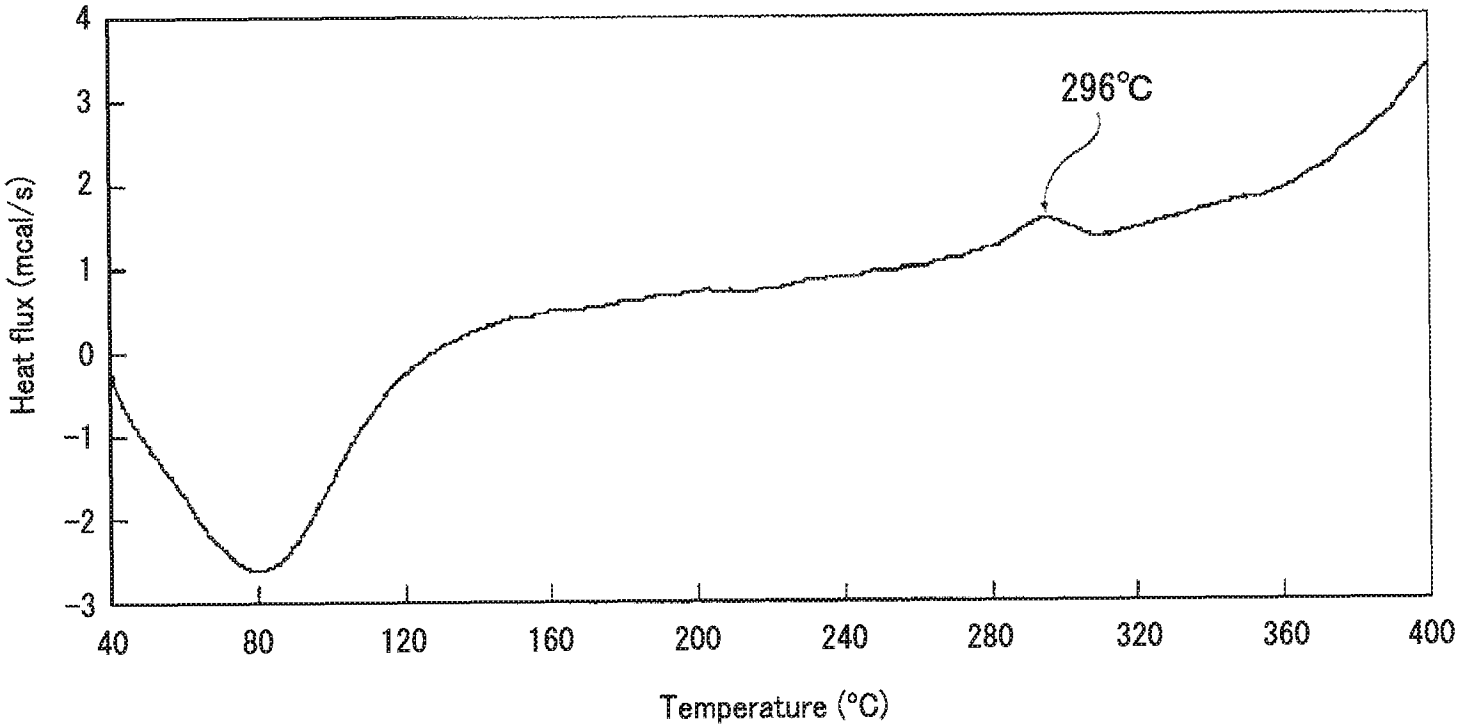
FIG. 5 is a differential scanning calorimetry spectral chart for the second example of titanyl phthalocyanine used in the electrophotographic photosensitive member according to the embodiment of the present disclosure.

FIGS. 2 and 3 are a CuKα characteristic X-ray diffraction spectral chart (FIG. 2) and a differential scanning calorimetry spectral chart (FIG. 3) for a first example of titanyl phthalocyanine crystals used in the electrophotographic photosensitive member according to the present embodiment. FIGS. 4 and 5 are a CuKα characteristic X-ray diffraction spectral chart (FIG. 4) and a differential scanning calorimetry spectral chart (FIG. 5) for a second example of titanyl phthalocyanine crystals used in the electrophotographic photosensitive member according to the present embodiment. In each of FIGS. 2 and 4, the horizontal axis represents Bragg angle (°) and the vertical axis represents intensity (cps). In each of FIGS. 3 and 5, the horizontal axis represents temperature (° C.) and the vertical axis represents heat flux (mcal/s). Each of the spectral charts (FIGS. 2 to 5) was obtained according to the above-described methods.

It is inferred from the spectral charts shown in FIGS. 2 and 3 that the first example of the titanyl phthalocyanine crystals that is measured mainly contains the Y-form titanyl phthalocyanine (B). No peak is observed in the range from 50° C. to 400° C. other than a peak resulting from vaporization of absorbed water in the differential scanning calorimetry spectral chart shown in FIG. 3. It is inferred from the spectral charts shown in FIGS. 4 and 5 that the second example of the titanyl phthalocyanine crystals that is measured mainly contains the Y-form titanyl phthalocyanine (C). A peak is present at 296° C. other than a peak resulting from vaporization of absorbed water in the differential scanning calorimetry spectral chart shown in FIG. 5.

<Synthesis Method of Titanyl Phthalocyanine Crystals>

Next a synthesis method of titanyl phthalocyanine crystals will be described. An example of a synthesis method of the Y-form titanyl phthalocyanine (B) will be described below.

First, a titanyl phthalocyanine compound is synthesized in accordance with a scheme (R-1) or (R-2) shown below. In the schemes (R-1) and (R-2), Y represents a halogen atom, an alkyl group, an alkoxy group, a cyano group, or a nitro group, e represents an integer of no less than 0 and no greater than 4, and R represents an alkyl group.

(R-1)

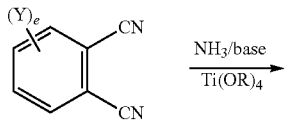

-continued

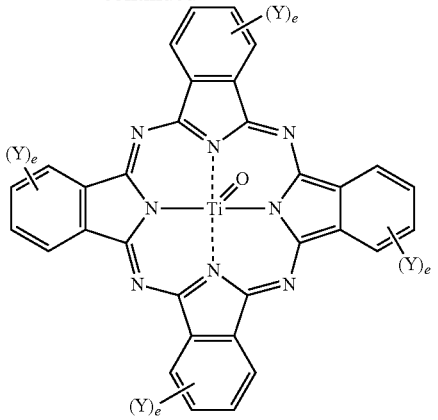

(R-2)

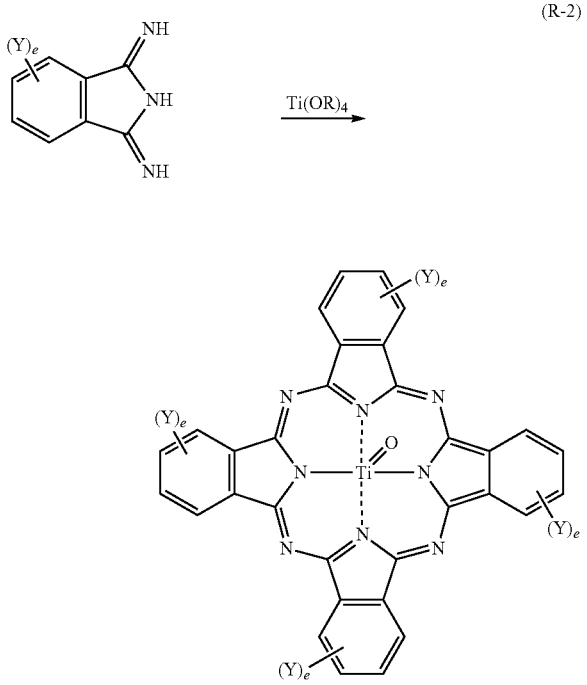

A titanyl phthalocyanine compound is synthesized in the scheme (R-1) through a reaction between phthalonitrile or a derivative thereof and titanium alkoxide. A titanyl phthalocyanine compound is synthesized in the scheme (R-2) through a reaction between 1,3-diiminoisoindoline or a derivative thereof and titanium alkoxide.

Next, pigmentation pretreatment is performed. More specifically, the titanyl phthalocyanine compound obtained through the scheme (R-1) or (R-2) is added to a water-soluble organic solvent and the resultant liquid mixture is stirred for a fixed time under heating. Thereafter, the resultant liquid mixture is left to stand for a certain period of time at a lower temperature than during stirring to perform stabilization.

In the pigmentation pretreatment, for example, one or more water-soluble organic solvents selected from the group consisting of alcohols (specific examples include methanol, ethanol, and isopropanol), N,N-dimethylformamide, N,N-dimethylacetamide, propionic acid, acetic acid, N-methylpyrrolidone, and ethylene glycol can be used. A small amount of water-insoluble organic solvent may be added to the water-soluble organic solvent. Stirring in the pigmentation pretreatment is preferably performed for no less than 1 hour and no greater than 3 hours at a fixed temperature (for example, a specific selected temperature in a range from 70° C. to 200° C.). Stabilization after stirring is preferably performed for no less than 5 hours and no greater than 10 hours at a fixed temperature. The temperature of the liquid mixture during stabilization is preferably no less than 10° C. and no greater than 50° C., and more preferably no less than 22° C. and no greater than 24° C.

Next, the water-soluble organic solvent is dried to yield crude crystals of the titanyl phthalocyanine compound. The crude crystals are subsequently dissolved in a solvent by a standard method and the resultant solution is then dripped into a poor solvent to cause recrystallization. Thereafter, the titanyl phthalocyanine compound is pigmented through filtration, water washing, milling treatment, filtration, and drying. As a result, the Y-form titanyl phthalocyanine (B) is obtained.

The poor solvent used for recrystallization can for example be one or more solvents selected from the group consisting of water, alcohols (specific examples include methanol, ethanol, and isopropanol), and water-soluble organic solvents (specific examples include acetone and dioxane).

The milling treatment is treatment in which a resultant solid after washing with water is dispersed in a non-aqueous solvent without being dried and while still containing water, and the resultant dispersion is subsequently stirred. The solvent used to dissolve the crude crystals can for example be one or more solvents selected from the group consisting of halogenated hydrocarbons (specific examples include dichloromethane, chloroform, ethyl bromide, and butyl bromide), trihaloacetic acids (specific examples include trifluoroacetic acid, trichloroacetic acid, and tribromoacetic acid), and sulfuric acid. The non-aqueous solvent used in the milling treatment can for example be a halogenated solvent such as chlorobenzene or dichloromethane.

The Y-form titanyl phthalocyanine (B) can also be synthesized according to the following method.

After the pigmentation pretreatment, the crude crystals of the titanyl phthalocyanine compound obtained after the water-soluble organic solvent is dried are treated by an acid paste method. More specifically, the crude crystals are dissolved in an acid and the resultant solution is dripped into water under ice cooling. Thereafter, the solution is stirred for a certain period of time at a temperature of no less than 22° C. and no greater than 24° C. and the titanyl phthalocyanine compound is caused to recrystallize in the liquid to yield a low-crystallinity titanyl phthalocyanine compound. Preferable examples of the acid used in the acid paste method include concentrated sulfuric acid and sulfonic acid.

Next, the low-crystallinity titanyl phthalocyanine compound is filtered and the resultant solid is washed with water. Thereafter, the milling treatment described above is performed. After the milling treatment, filtration and drying of the resultant solid are performed to yield the Y-form titanyl phthalocyanine (B).

(Electron Transport Material)

The electron transport material in the photosensitive layer contains at least one first compound (ETM1) represented by the formula (1) or (2) and at least one second compound (ETM2) represented by the formula (3), (4), or (5). The formulae (1) to (5) are shown below in order, and the first compound (ETM1) and the second compound (ETM2) will be described in detail.

(1)

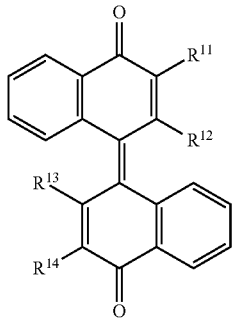

In the formula (1). $R^{11}$, $R^{12}$, $R^{13}$, and $R^{14}$ each represent, independently of one another, a chemical group selected from the group consisting of a hydrogen atom, an optionally substituted alkyl group (straight-chain, branched, or ring), an optionally substituted alkoxy group, an optionally substituted aryl group, and an optionally substituted aralkyl group. $R^{11}$, $R^{12}$, $R^{13}$, and $R^{14}$ may be the same as or different from one another.

When at least one of $R^{11}$ to $R^{14}$ is an alkyl group in the formula (1), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, an n-decyl group, or an cyclohexyl group. When at least one of $R^{11}$ to $R^{14}$ is an alkoxy group in the formula (1), the alkoxy group is particularly preferably a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, an n-decyloxy group, a phenoxy group, a naphthyloxy group, an anthryloxy group, or a phenanthryloxy group. When at least one of $R^{11}$ to $R^{14}$ is an aryl group in the formula (1), the aryl group is particularly preferably a phenyl group, a naphthyl group, an anthryl group, or a phenanthryl group. When at least one of $R^{11}$ to $R^{14}$ is an aralkyl group in the formula (1), the aralkyl group is particularly preferably a benzyl group, a phenethyl group, an α-naphthylmethyl group, or a β-naphthylmethy group.

Preferably, $R^{11}$ to $R^{14}$ in the formula (1) each represent, independently of one another, a hydrogen atom, a straight-chain or branched alkyl group having a carbon number of no less than 1 and no greater than 8 (more preferably, a carbon number of no less than 1 and no greater than 6), a cyclohexyl group, an alkoxy group having a carbon number of no less than 1 and no greater than 4 (more preferably, a carbon number of 1 or 2), a phenyl group, or a benzyl group in order to improve charge stability of the photosensitive layer. Examples of ETM1 represented by the formula (1) that may be favorably used include compounds (dinaphthoquinone derivatives) represented by any of formulae (1-1) to (1-11) shown below.

(1-1)

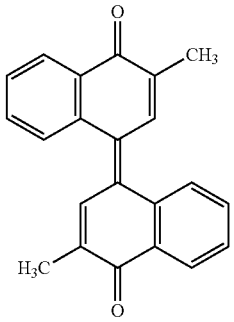

(1-2)

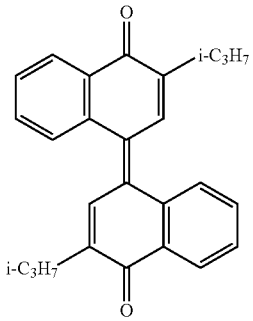

(1-3)

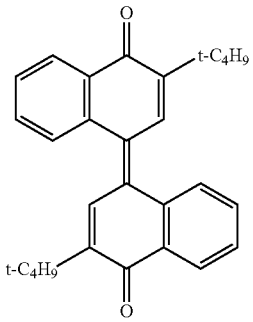

(1-4)

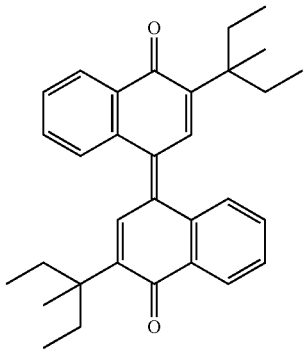

-continued (1-5)

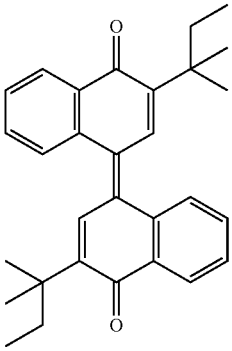

(1-6)

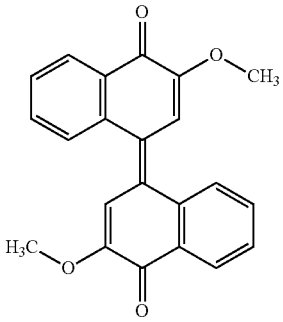

(1-7)

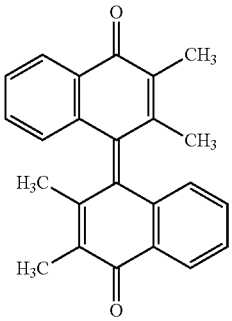

(1-8)

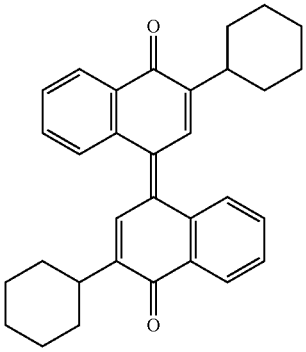

-continued (1-9)

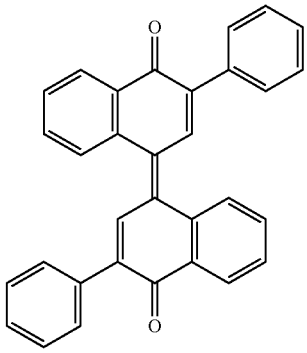

(1-10)

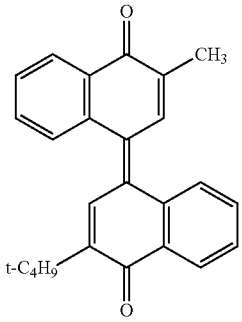

(1-11)

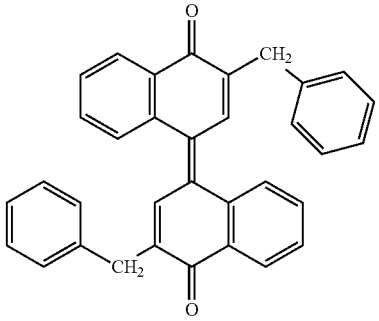

With respect to the formulae (1-1) to (1-11), $R^{11}$ to $R^{14}$ in the formula (1) are as follows.

(1-1)

$R^{11}$ and $R^{14}$: an alkyl group having a carbon number of 1 (methyl group); $R^{12}$ and $R^{13}$: a hydrogen atom (1-2)

$R^{11}$ and $R^{14}$: a branched alkyl group having a carbon number of 3 (isopropyl group); $R^{12}$ and $R^{13}$: a hydrogen atom (1-3)

$R^{11}$ and $R^{14}$: a branched alkyl group having a carbon number of 4 (tertiary butyl group); $R^{12}$ and $R^{13}$: a hydrogen atom (1-4)

$R^{11}$ and $R^{14}$: a branched alkyl group having a carbon number of 6 (hexyl group); $R^{12}$ and $R^{13}$: a hydrogen atom (1-5)

$R^{11}$ and $R^{14}$: a branched alkyl group having a carbon number of 5 (pentyl group); $R^{12}$ and $R^{13}$: a hydrogen atom (1-6)

$R^{11}$ and $R^{14}$: an alkoxy group having a carbon number of 1 (methoxy group); $R^{12}$ and $R^{13}$: a hydrogen atom (1-7)

$R^{11}$ to $R^{14}$: an alkyl group having a carbon number of 1 (methyl group)

(1-8)

$R^{11}$ and $R^{14}$: a cyclohexyl group; $R^{12}$ and $R^{13}$: a hydrogen atom (1-9)

$R^{11}$ and $R^{14}$: a phenyl group; $R^{12}$ and $R^{13}$: a hydrogen atom (1-10)

$R^{11}$: an alkyl group having a carbon number of 1 (methyl group); $R^{12}$ and $R^{13}$: a hydrogen atom; $R^{14}$: a branched alkyl group having a carbon number of 4 (tertiary butyl group)

(1-11)

$R^{11}$ and $R^{14}$: a benzyl group; $R^{12}$ and $R^{13}$: a hydrogen atom (2)

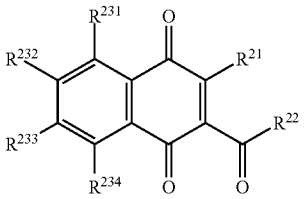

In the formula (2), $R^{21}$ represents an optionally substituted alkyl group (straight-chain, branched, or ring) or an optionally substituted aryl group, $R^{22}$ represents an optionally substituted alkyl group, an optionally substituted aryl group, or a group represented by formula —O—X in which X represents an optionally substituted alkyl group, an optionally substituted aryl group, or an optionally substituted aralkyl group, $R^{231}$ to $R^{234}$ each represent, independently of one another, a hydrogen atom or an optionally substituted alkyl group, and $R^{21}$, $R^{22}$, and $R^{231}$ to $R^{234}$ may be the same as or different from one another.

When at least one of $R^{21}$, $R^{22}$, $R^{231}$ to $R^{234}$, and X in the formula —O—X is an alkyl group in the formula (2), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, or an n-decyl group. When at least one of $R^{21}$, $R^{22}$, and X in the formula —O—X is an aryl group in the formula (2), the aryl group is particularly preferably a phenyl group, a naphthyl group, an anthryl group, or a phenanthryl group. When X in the formula —O—X is an aralkyl group, the aralkyl group is particularly preferably a benzyl group, a phenethyl group, an α-naphthylmethyl group, or a β-naphthylmethyl group.

In order to improve charge stability of the photosensitive layer, it is particularly preferable that $R^{21}$ in the formula (2) represents a chemical group selected from the group consisting of a straight-chain or branched alkyl group having a carbon number of no less than 1 and no greater than 4 (more preferably, a carbon number of 1 or 2), a phenyl group, and a phenyl group having a straight-chain or branched alkyl group having a carbon number of no less than 1 and no greater than 4 (more preferably a carbon number of 1 or 2) as a substituent, $R^{22}$ represents a chemical group selected from the group consisting of a straight-chain or branched alkyl group having a carbon number of no less than 1 and no greater than 6 (more preferably, a carbon number of no less than 1 and no greater than 4), a phenyl group, a phenyl group having a straight-chain or branched alkyl group having a carbon number of no less than 1 and no greater than 4 (more preferably a carbon number of 1 or 2) as a substituent, and a chemical group represented by the formula —O—X in which X represents a straight-chain or branched alkyl group having a carbon number of no less than 1 and no greater than 6 (more preferably, a carbon number of no less than 1 and no greater than 4), a phenyl group, a phenyl group having a straight-chain or branched alkyl group having a carbon number of no less than 1 and no greater than 4 (more preferably, a carbon number of 1 or 2) as a substituent, a benzyl group, or a benzyl group having a straight-chain or branched alkyl group having a carbon number of no less than 1 and no greater than 4 (more preferably, a carbon number of 1 or 2) as a substituent, and $R^{23}$ to $R^{234}$ each represent, independently of one another, a hydrogen atom or a straight-chain or branched alkyl group having a carbon number of no less than 1 and no greater than 6 (more preferably, a carbon number of no less than 1 and no greater than 4). Examples of ETM1 represented by the formula (2) that may be favorably used include compounds (naphthoquinone derivatives) represented by any of formulae (2-1) to (2-26) shown below.

(2-1)

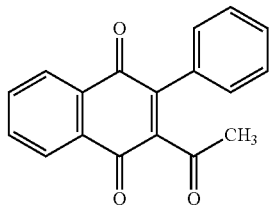

(2-2)

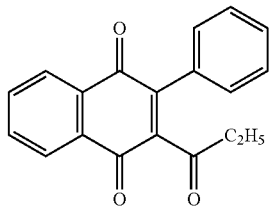

(2-3)

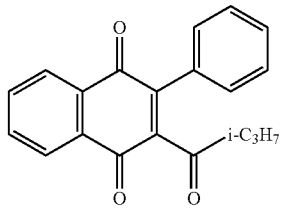

(2-4)

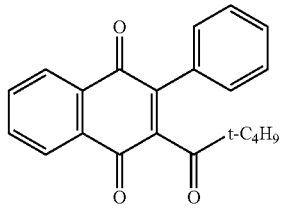

(2-5)

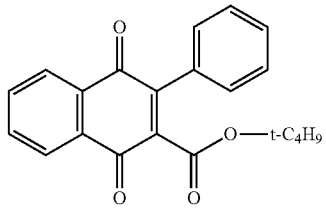

-continued
(2-6)
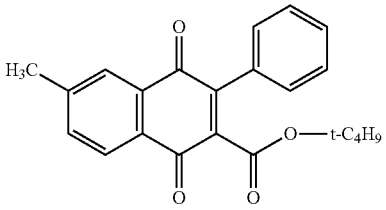
(2-7)
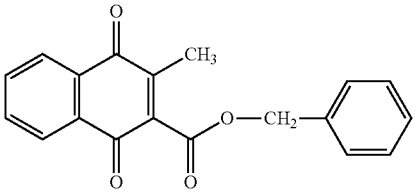
(2-8)
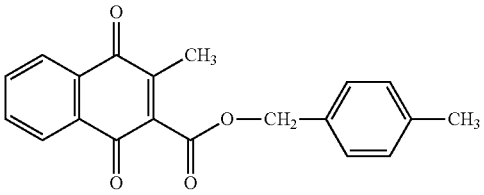
(2-9)
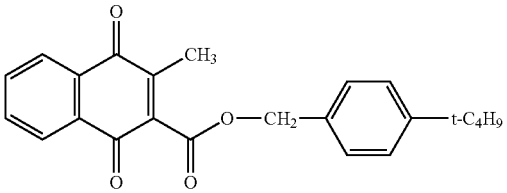
(2-10)
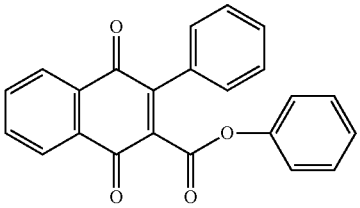
(2-11)
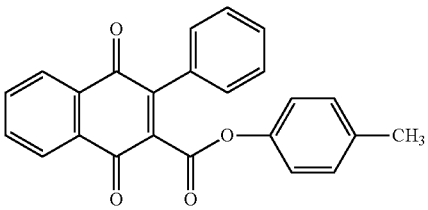
(2-12)
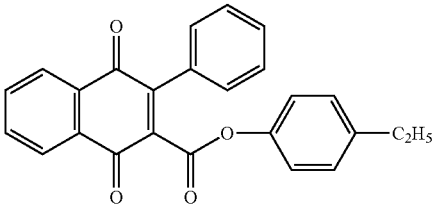
-continued
(2-13)
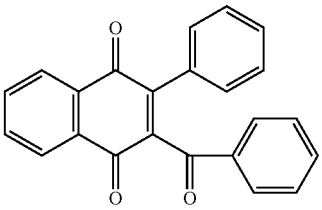
(2-14)
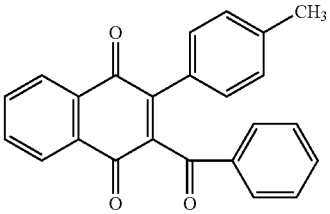
(2-15)
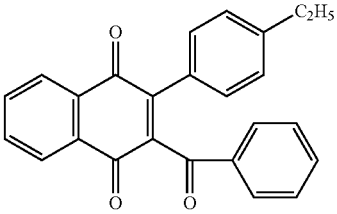
(2-16)
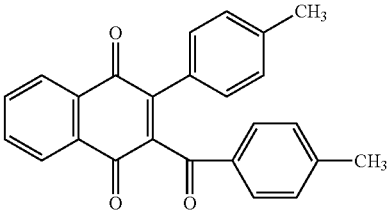
(2-17)
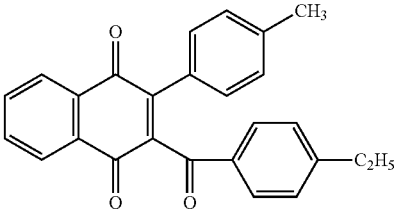
(2-18)
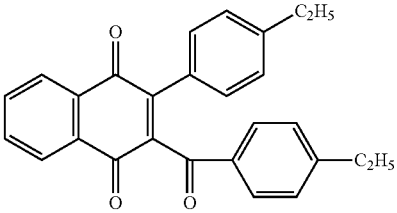

-continued (2-19)

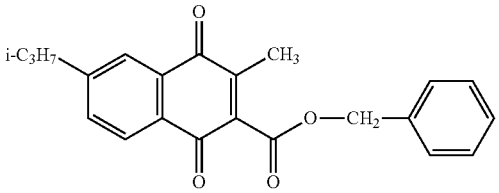

(2-20)

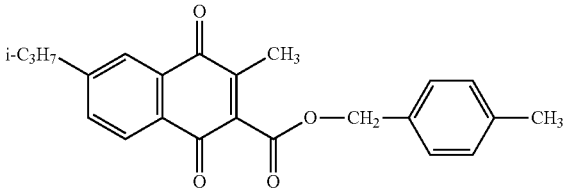

(2-21)

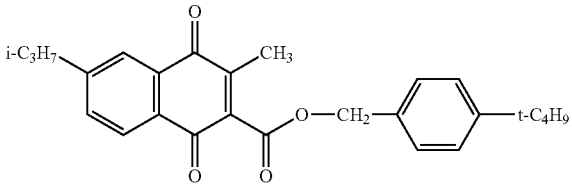

(2-22)

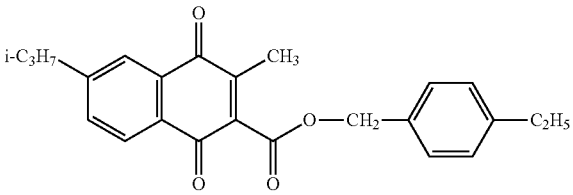

(2-23)

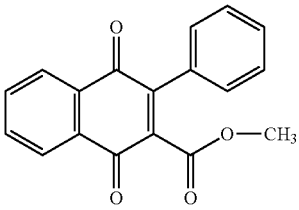

(2-24)

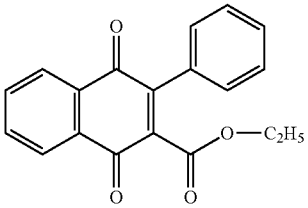

(2-25)

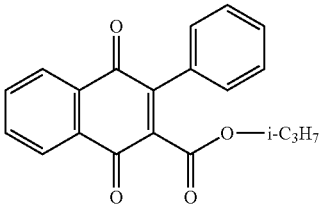

-continued (2-26)

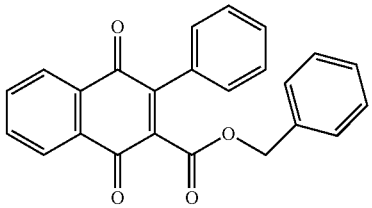

With respect to the formulae (2-1) to (2-26), $R^{21}$, $R^{22}$, and $R^{231}$ to $R^{234}$ in the formula (2) are as follows.

(2-1)

$R^{21}$: a phenyl group; $R^{22}$: an alkyl group having a carbon number of 1 (methyl group); $R^{231}$ to $R^{234}$: a hydrogen atom (2-2)

$R^{21}$: a phenyl group; $R^{22}$: an alkyl group having a carbon number of 2 (ethyl group); $R^{231}$ to $R^{234}$: a hydrogen atom (2-3)

$R^{21}$: a phenyl group; $R^{22}$: a branched alkyl group having a carbon number of 3 (isopropyl group): $R^{231}$ to $R^{23}$: a hydrogen atom (2-4)

$R^{21}$: a phenyl group; $R^{22}$: a branched alkyl group having a carbon number of 4 (tertiary butyl group); $R^{231}$ to $R^{234}$: a hydrogen atom (2-5)

$R^{21}$: a phenyl group; $R^{22}$: a —O—X group; X: a branched alkyl group having a carbon number of 4 (tertiary butyl group); $R^{231}$ to $R^{234}$: a hydrogen atom (2-6)

$R^{21}$: a phenyl group; $R^{22}$: a —O—X group; X: a branched alkyl group having a carbon number of 4 (tertiary butyl group); $R^{232}$: an alkyl group having a carbon number of 1 (methyl group); $R^{231}$, $R^{233}$, and $R^{234}$: a hydrogen atom (2-7)

$R^{21}$: an alkyl group having a carbon number of 1 (methyl group); $R^{22}$: a —O—X group; X: a benzyl group; $R^{231}$ to $R^{234}$: a hydrogen atom (2-8)

$R^{21}$: an alkyl group having a carbon number of 1 (methyl group); $R^{22}$: a —O—X group; X: a benzyl group having an alkyl group having a carbon number of 1 (methyl group) as a substituent; $R^{231}$ to $R^{234}$: a hydrogen atom (2-9)

$R^{21}$: an alkyl group having a carbon number of 1 (methyl group); $R^{22}$: a —O—X group; X: a benzyl group having a branched alkyl group having a carbon number of 4 (tertiary butyl group) as a substituent; $R^{231}$ to $R^{234}$: a hydrogen atom (2-10)

$R^{21}$: a phenyl group; $R^{22}$: a —O—X group; X: a phenyl group; $R^{231}$ to $R^{234}$: a hydrogen atom (2-11)

$R^{21}$: an alkyl group having a carbon number of 1 (methyl group); $R^{22}$: a —O—X group; X: a phenyl group having an alkyl group having a carbon number of 1 (methyl group) as a substituent; $R^{231}$ to $R^{234}$: a hydrogen atom (2-12)

$R^{21}$: a phenyl group; $R^{22}$: a —O—X group; X: a phenyl group having an alkyl group having a carbon number of 2 (ethyl group) as a substituent; $R^{231}$ to $R^{34}$: a hydrogen atom (2-13)

$R^{21}$ and $R^{22}$: a phenyl group; $R^{231}$ to $R^{234}$: a hydrogen atom (2-14)

$R^{21}$: a phenyl group having an alkyl group having a carbon number of 1 (methyl group) as a substituent; $R^{22}$: a phenyl group; $R^{231}$ to $R^{234}$: a hydrogen atom (2-15)

$R^{21}$: a phenyl group having an alkyl group having a carbon number of 2 (ethyl group) as a substituent; $R^{22}$: a phenyl group; $R^{231}$ to $R^{234}$: a hydrogen atom (2-16)

$R^{21}$ and $R^{22}$: a phenyl group having an alkyl group having a carbon number of 1 (methyl group) as a substituent; $R^{231}$ to $R^{234}$: a hydrogen atom (2-17)

$R^{21}$: a phenyl group having an alkyl group having a carbon number of 1 (methyl group) as a substituent; $R^{22}$: a phenyl group having an alkyl group having a carbon number of 2 (ethyl group) as a substituent; $R^{231}$ to $R^{234}$: a hydrogen atom (2-18)

$R^{21}$ and $R^{22}$: a phenyl group having an alkyl group having a carbon number of 2 (ethyl group) as a substituent; $R^{231}$ to $R^{234}$: a hydrogen atom (2-19)

$R^{21}$: an alkyl group having a carbon number of 1 (methyl group); $R^{22}$: a —O—X group; X: a benzyl group; $R^{232}$: a branched alkyl group having a carbon number of 3 (isopropyl group); $R^{231}$, $R^{233}$, and $R^{234}$: a hydrogen atom (2-20)

$R^{21}$: an alkyl group having a carbon number of 1 (methyl group); $R^{22}$: a —O—X group; X: a benzyl group having an alkyl group having a carbon number of 1 (methyl group) as a substituent; $R^{232}$: a branched alkyl group having a carbon number of 3 (isopropyl group); $R^{231}$, $R^{233}$, and $R^{234}$: a hydrogen atom (2-21)

$R^{21}$: an alkyl group having a carbon number of 1 (methyl group); $R^{22}$: a —O—X group; X: a benzyl group having a branched alkyl group having a carbon number of 4 (tertiary butyl group) as a substituent; $R^{232}$: a branched alkyl group having a carbon number of 3 (isopropyl group); $R^{231}$, $R^{233}$, and $R^{234}$: a hydrogen atom (2-22)

$R^{21}$: an alkyl group having a carbon number of 1 (methyl group); $R^{22}$: a —O—X group; X: a benzyl group having an alkyl group having a carbon number of 2 (ethyl group) as a substituent; $R^{232}$: a branched alkyl group having a carbon number of 3 (isopropyl group); $R^{231}$, $R^{233}$, and $R^{234}$: a hydrogen atom (2-23)

$R^{21}$: a phenyl group; $R^{22}$: a —O—X group; X: an alkyl group having a carbon number of 1 (methyl group); $R^{231}$ to $R^{234}$: a hydrogen atom (2-24)

$R^{21}$: a phenyl group; $R^{22}$: a —O—X group; X: an alkyl group having a carbon number of 2 (ethyl group); $R^{231}$ to $R^{234}$: a hydrogen atom (2-25)

$R^{21}$: a phenyl group; $R^{22}$: a —O—X group; X: a branched alkyl group having a carbon number of 3 (isopropyl group); $R^{231}$ to $R^{234}$: a hydrogen atom (2-26)

$R^{21}$: a phenyl group $R^{22}$: a —O—X group; a —O—X group; X: a benzyl group; $R^{231}$ to $R^{234}$: a hydrogen atom (3)

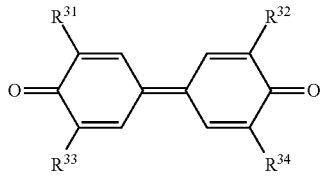

(4)

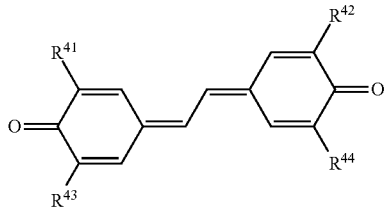

(5)

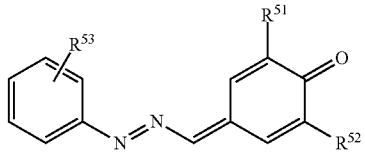

In the formula (3), (4) or (5), $R^{31}$, $R^{32}$, $R^{33}$, $R^{34}$, $R^{41}$, $R^{42}$, $R^{43}$, $R^{44}$, $R^{51}$, and $R^{52}$ each represent, independently of one another, a chemical group selected from the group consisting of a hydrogen atom, an optionally substituted alkyl group (straight-chain, branched, or ring), an optionally substituted alkenyl group, an optionally substituted alkoxy group, an optionally substituted aryl group, an optionally substituted aralkyl group, and an optionally substituted heterocyclic group, and $R^{53}$ represents a chemical group selected from the group consisting of a hydrogen atom, a halogen atom, an optionally substituted alkyl group (straight-chain, branched, or ring), an optionally substituted alkenyl group, an optionally substituted alkoxy group, an optionally substituted aryl group, an optionally substituted aralkyl group, and an optionally substituted heterocyclic group. $R^{31}$, $R^{32}$, $R^{33}$, $R^{34}$, $R^{41}$, $R^{42}$, $R^{43}$, $R^{44}$, $R^{51}$, $R^{52}$, and $R^{53}$ may be the same as or different from one another.

When at least one of $R^{31}$ to $R^{34}$, $R^{41}$ to $R^{44}$, and $R^{51}$ to $R^{53}$ is an alkyl group in the formulae (3) to (5), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, an n-decyl group, or an cyclohexyl group. When at least one of $R^{31}$ to $R^{34}$, $R^{41}$ to $R^{44}$, and $R^{51}$ to $R^{53}$ is an alkenyl group in the formulae (3) to (5), the alkenyl group is particularly preferably a vinyl group or an allyl group. When at least one of $R^{31}$ to $R^{34}$, $R^{41}$ to $R^{44}$, and $R^{51}$ to $R^{53}$ is an alkoxy group in the formulae (3) to (5), the alkoxy group is particularly preferably a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, an n-decyloxy group, a phenoxy group, a naphthyloxy group, an anthryloxy group, or a phenanthryloxy group. When at least one of $R^{31}$ to $R^{34}$, $R^{41}$ to $R^{44}$, and $R^{51}$ to $R^{53}$ is an aryl group in the formulae (3) to (5), the aryl group is particularly preferably a phenyl group, a naphthyl group, an anthryl group, or a phenanthryl group. When at least one of $R^{31}$ to $R^{34}$, $R^{41}$ to $R^{44}$, and $R^{51}$ to $R^{53}$ is an aralkyl group in the formulae (3) to (5), the aralkyl group is particularly preferably a benzyl group, a phenethyl group, an α-naphthylmethyl group, or a β-naphthylmethyl group. When $R^{53}$ is a halogen atom in the formula (5), the halogen atom is particularly preferably fluorine, chlorine, bromine, or iodine. When $R^{53}$ is a heterocyclic group in the formula (5), the heterocyclic group is particularly preferably a pyridine group.

In order to improve charge stability of the photosensitive layer, it is particularly preferable that $R^{31}$ to $R^{34}$ in the formula (3) each represent, independently of one another, a straight-chain or branched alkyl group having a carbon number of no less than 1 and no greater than 8 (more preferably no less than 1 and no greater than 6), a phenyl group, or a cyclohexyl group. Examples of ETM2 represented by the formula (3) that may be favorably used include compounds represented by any of formulae (3-1) to (3-10) shown below.

(3-1)

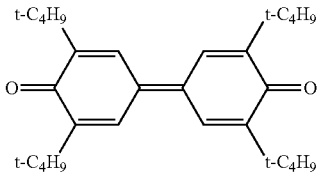

(3-2)

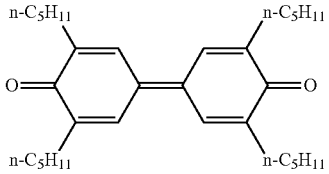

(3-3)

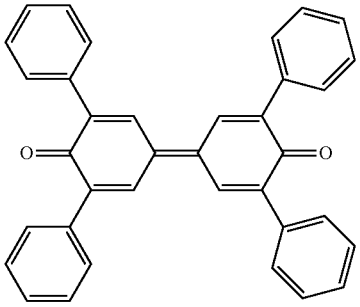

-continued (3-4)

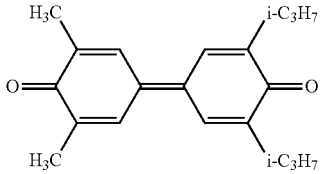

(3-5)

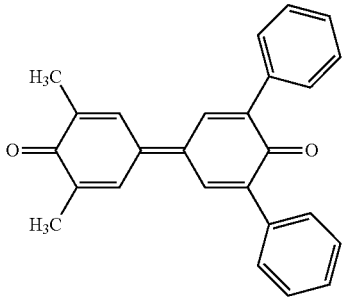

(3-6)

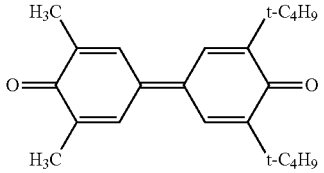

(3-7)

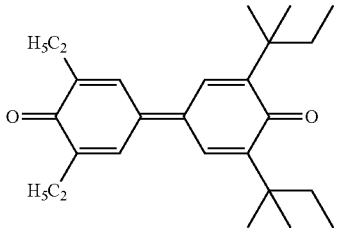

(3-8)

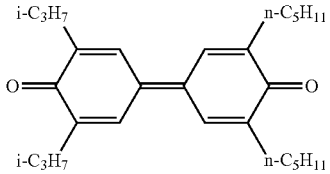

(3-9)

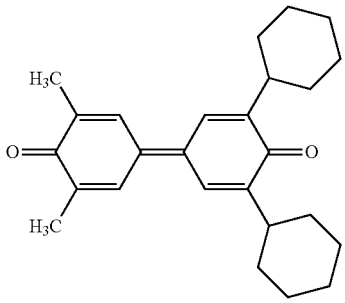

-continued (3-10)

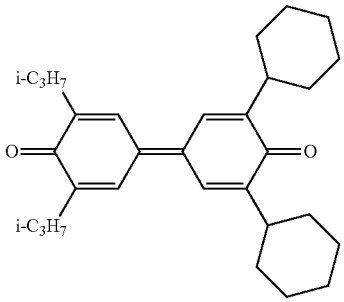

With respect to the formulae (3-1) to (3-10). $R^{31}$ to $R^{34}$ in the formula (3) are as follows.

(3-1)

$R^{31}$ to $R^{34}$: a branched alkyl group having a carbon number of 4 (tertiary butyl group)

(3-2)

$R^{31}$ to $R^{34}$: a straight-chain alkyl group having a carbon number of 5 (normal pentyl group)

(3-3)

$R^{31}$ to $R^{34}$: a phenyl group (3-4)

$R^{31}$ and $R^{33}$: an alkyl group having a carbon number of 1 (methyl group); $R^{32}$ and $R^{34}$: a branched alkyl group having a carbon number of 3 (isopropyl group)

(3-5)

$R^{31}$ and $R^{33}$: an alkyl group having a carbon number of 1 (methyl group); $R^{32}$ and $R^{34}$: a phenyl group (3-6)

$R^{31}$ and $R^{33}$: an alkyl group having a carbon number of 1 (methyl group); $R^{32}$ and $R^{34}$: a branched alkyl group having a carbon number of 4 (tertiary butyl group)

(3-7)

$R^{31}$ and $R^{33}$: an alkyl group having a carbon number of 2 (ethyl group); $R^{32}$ and $R^{34}$: a branched alkyl group having a carbon number of 5 (pentyl group)

(3-8)

$R^{31}$ and $R^{33}$: a branched alkyl group having a carbon number of 3 (isopropyl group); $R^{32}$ and $R^{34}$: a straight-chain alkyl group having a carbon number of 5 (normal pentyl group)

(3-9)

$R^{31}$ and $R^{33}$: an alkyl group having a carbon number of 1 (methyl group); $R^{32}$ and $R^{34}$; a cyclohexyl group (3-10)

$R^{31}$ and $R^{33}$: a branched alkyl group having a carbon number of 3 (isopropyl group); $R^{32}$ and $R^{34}$: a cyclohexyl group In order to improve charge stability of the photosensitive layer, it is particularly preferable that $R^{41}$ to $R^{44}$ in the formula (4) each represent, independently of one another, a straight-chain or branched alkyl group having a carbon number of no less than 1 and no greater than 8 (more preferably no less than 1 and no greater than 6). Examples of ETM2 represented by the formula (4) that may be favorably used include compounds represented by any of formulae (4-1) to (4-4) shown below.

(4-1)

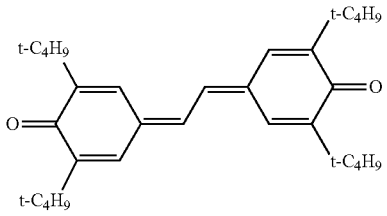

(4-2)

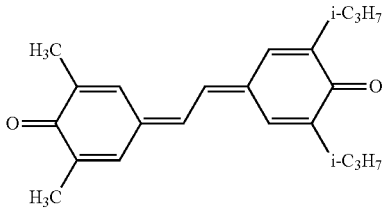

(4-3)

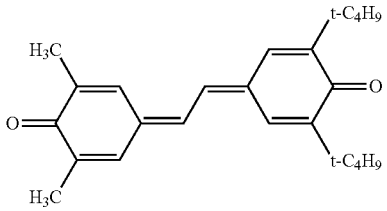

(4-4)

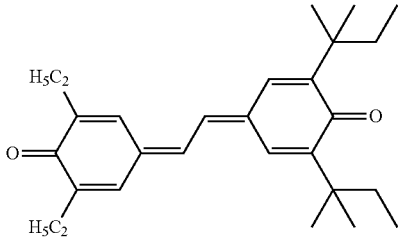

With respect to the formulae (4-1) to (4-4), $R^{41}$ to $R^{44}$ in the formula (4) are as follows.

(4-1)

$R^{41}$ to $R^{44}$: a branched alkyl group having a carbon number of 4 (tertiary butyl group)

(4-2)

$R^{41}$ and $R^{43}$: an alkyl group having a carbon number of 1 (methyl group); $R^{42}$ and $R^{44}$: a branched alkyl group having a carbon number of 3 (isopropyl group)

(4-3)

$R^{41}$ and $R^{43}$: an alkyl group having a carbon number of 1 (methyl group); $R^{42}$ and $R^{44}$: a branched alkyl group having a carbon number of 4 (tertiary butyl group)

(4-4)

$R^{41}$ and $R^{43}$: an alkyl group having a carbon number of 2 (ethyl group); $R^{42}$ and $R^{44}$: a branched alkyl group having a carbon number of 5 (pentyl group)

In order to improve charge stability of the photosensitive layer, it is particularly preferable that $R^{51}$ and $R^{52}$ in the formula (5) each represent, independently of one another, a straight-chain or branched alkyl group having a carbon number of no less than 1 and no greater than 6 (more preferably, a carbon number of no less than 1 and no greater than 4), and $R^{53}$ is a halogen atom (more preferably, fluorine, chlorine, bromine, or iodine). Examples of ETM2 represented by the formula (5) that may be favorably used include compounds represented by formula (5-1) shown below.

(5-1)

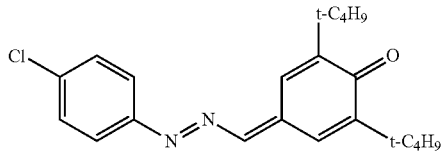

With respect to the formula (5-1), $R^{51}$ to $R^{53}$ in the formula (5) are as follows.

(5-1)

$R^{51}$ and $R^{52}$: a branched alkyl group having a carbon number of 4 (tertiary butyl group); $R^{53}$: a halogen atom (chlorine)

(Hole Transport Material)

The photosensitive layer contains a hole transport material. In order to restrict crystallization in the photosensitive layer while also stabilizing surface potential of the photosensitive layer, the photosensitive layer preferably contains a compound represented by formula (HTM-1) shown below as the hole transport material.

(HTM-1)

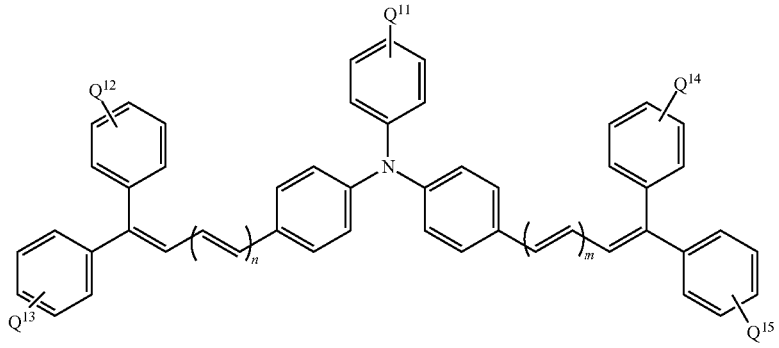

In the formula (HTM-1), $Q^{11}$, $Q^{12}$, $Q^{13}$, $Q^{14}$, and $Q^{15}$ each represent, independently of one another, a hydrogen atom, a halogen atom, an optionally substituted alkyl group (straight-chain, branched, or ring), an optionally substituted alkoxy group, an optionally substituted aryl group, an optionally substituted aryloxy group, or an optionally substituted aralkyl group. In the formula (HTM-1), m and n each represent, independently of one another, an integer of no less than 0 and no greater than 4.

When at least one of $Q^{11}$ to $Q^{15}$ is a halogen atom in the formula (HTM-1), the halogen atom is particularly preferably fluorine, chlorine, bromine, or iodine. When at least one of $Q^{11}$ to $Q^{15}$ is an alkyl group in the formula (HTM-1), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, or an n-decyl group. When at least one of $Q^{11}$ to $Q^{15}$ is an alkoxy group in the formula (HTM-1), the alkoxy group is particularly preferably a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, or an n-decyloxy group. When at least one of $Q^{11}$ to $Q^{15}$ is an aryl group in the formula (HTM-1), the aryl group is particularly preferably a phenyl group, a naphthyl group, an anthryl group, or a phenanthryl group. When at least one of $Q^{11}$ to $Q^{15}$ is an aryloxy group in the formula (HTM-1), the aryloxy group is particularly preferably a phenoxy group, a naphthyloxy group, an anthryloxy group, or a phenanthryloxy group. When at least one of $Q^{11}$ to $Q^{15}$ is an aralkyl group in the formula (HTM-1), the aralkyl group is particularly preferably a benzyl group, a phenethyl group, an α-naphthylmethyl group, or a β-naphthylmethy group. In order to improve charge stability of the photosensitive layer, it is particularly preferable that in the formula (HTM-1), $Q^{11}$ to $Q^{15}$ each represent, independently of one another, a hydrogen atom, an alkyl group having a carbon number of no less than 1 and no greater than 6, or an alkoxy group having a carbon number of no less than 1 and no greater than 6, and m and n each represent, independently of one another, 0 or 1.

Other than the compound represented by the formula (HTM-1), the hole transport material contained in the photosensitive layer is preferably a compound represented by any of the formulae (HTM-2) to (HTM-4) shown below.

(HTM-2)

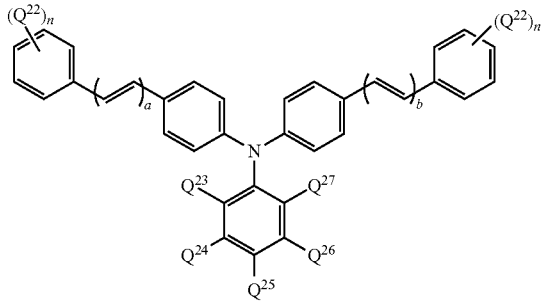

In the formula (HTM-2), $Q^{22}$, $Q^{23}$, $Q^{24}$, $Q^{25}$, $Q^{26}$, and $Q^{27}$ each represent, independently of one another, a hydrogen atom, an alkyl group having a carbon number of no less than 1 and no greater than 8, an alkoxy group having a carbon number of no less than 1 and no greater than 8, and an optionally substituted aryl group having a carbon number of no less than 6 and no greater than 30. In the formula (HTM-2), n represents an integer of no less than 0 and no greater than 5. Adjacent chemical groups among $Q^{23}$, $Q^{24}$, $Q^{25}$, $Q^{26}$, and $Q^{27}$ may be bonded to one another to form a ring. In the formula (HTM-2), a and b each represent an integer of no less than 1 and no greater than 3, and may be the same as or different from one another.

(HTM-3)

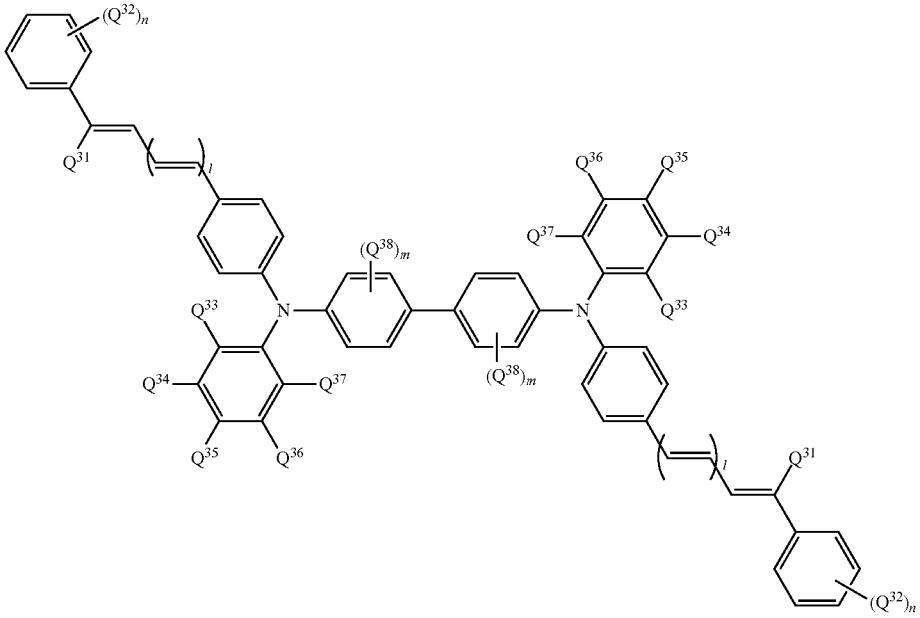

In the formula (HTM-3), $Q^{31}$, $Q^{32}$, $Q^{33}$, $Q^{34}$, $Q^{35}$, $Q^{36}$, $Q^{37}$, and $Q^{38}$ each represent, independently of one another, a hydrogen atom, an alkyl group having a carbon number of no less than 1 and no greater than 8, an alkoxy group having a carbon number of no less than 1 and no greater than 8, and a phenyl group. In the formula (HTM-3), n represents an integer of no less than 0 and no greater than 5. In the formula (HTM-3), m represents an integer of no less than 0 and no greater than 4. In the formula (HTM-3), l represents 0 or 1. Adjacent chemical groups among $Q^{33}$, $Q^{34}$, $Q^{35}$, $Q^{36}$, and $Q^{37}$ may be bonded to one another to form a ring.

In the formula (HTM-4), $Q^{411}$ to $Q^{415}$, $Q^{421}$ to $Q^{425}$, and $Q^{431}$ to $Q^{434}$ each represent, independently of one another, a hydrogen atom, an alkyl group having a carbon number of no less than 1 and no greater than 8, an alkoxy group having a carbon number of no less than 1 and no greater than 8, or a phenyl group.

The photosensitive layer may contain a hole transport material other than the above-described hole transport materials. Alternatively or additionally, a hole transport material that functions as a binder resin (for example, a hole transport material having film forming capability) may be used. For example, polyvinyl carbazole functions as a hole transport (HTM-4)

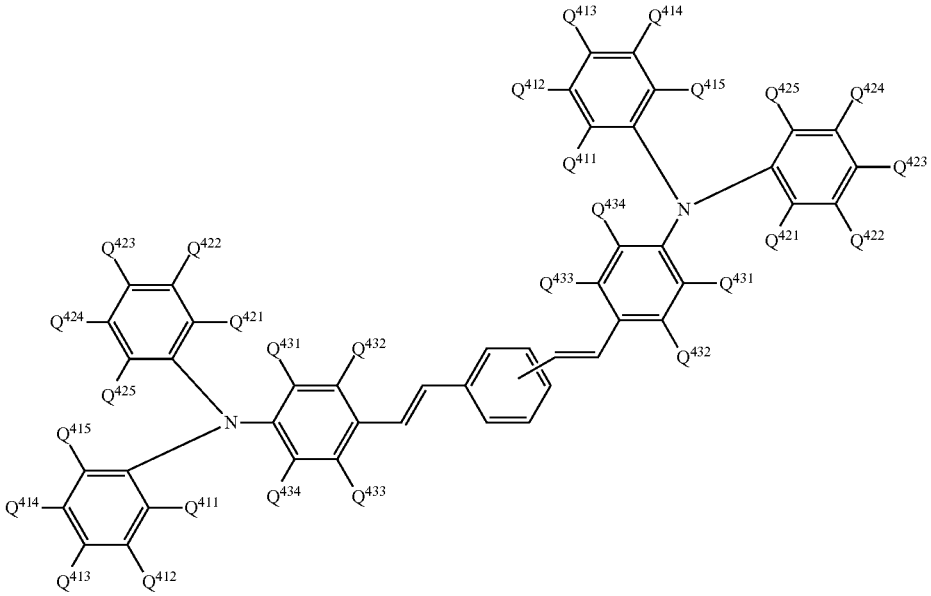

material and as a binder resin. One hole transport material may be used independently, or two or more hole transport materials may be used in a combination.

The amount of the hole transport material contained in the photosensitive member is preferably no less than 10 parts by mass and no greater than 200 parts by mass relative to 100 parts by mass of the binder resin, and more preferably no less than 10 parts by mass and no greater than 100 parts by mass.

(Binder Resin)

Examples of binder resins that may be used include thermoplastic resins, thermosetting resins, and photocurable resins. Specific examples of binder resins that may be favorably used include: thermoplastic resins such as polycarbonate resins, styrene-based resins, styrene-butadiene copolymers, styrene-acrylonitrile copolymers, styrene-maleic acid copolymers, styrene-acrylic acid copolymers, acrylic acid-based copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, polyether resins, and polyester resins; thermosetting resins such as silicone resins, epoxy resins, phenolic resins, urea resins, and melamine resins; and photocurable resins such as epoxy acrylate resins and urethane acrylate copolymers.

Preferably, a polycarbonate resin is used as a binder resin in order to obtain a photosensitive layer having excellent workability, mechanical characteristics, optical characteristics, and abrasion resistance. More preferably, a polycarbonate resin having a repeating unit represented by formula (Resin-1) shown below is used.

(Resin-1)

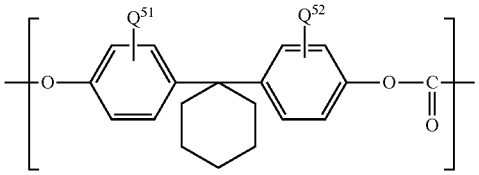

In the formula (Resin-1), $Q^{51}$ and $Q^{52}$ each represent, independently of one another, a hydrogen atom or an optionally substituted alkyl group having a carbon number of no less than 1 and no greater than 3.

When at least one of $Q^{51}$ and $Q^{52}$ is an alkyl group in the formula (Resin-1), the alkyl group is particularly preferably a methyl group, an ethyl group, an n-propyl group, or an iso-propyl group.

The polycarbonate resin used as a binder resin is not limited to resins having the above-described structure. For example, any of bisphenol Z polycarbonate resin, bisphenol B polycarbonate resin, bisphenol CZ polycarbonate resin, bisphenol C polycarbonate resin, and bisphenol A polycarbonate resin may be used as a binder resin. One binder resin may be used independently, or two or more binder resins may be used in a combination.

The binder resin preferably has a viscosity average molecular weight of no less than 20,000, and more preferably a viscosity average molecular weight of no less than 20,000 and no greater than 65,000. As a result of the binder resin having a viscosity average molecular weight of no less than 20,000, a dense photosensitive layer is readily formed, making it easier to improve gas resistance, abrasion resistance, and repeated use resistance of the photosensitive layer. As a result of the binder resin having a viscosity average molecular weight of no greater than 65,000, solvent solubility of the binder resin can be restricted during the photosensitive layer formation.

(Additive)

At least one of the photosensitive layer, the intermediate layer, and the protective layer in the photosensitive member of the present embodiment may contain one or more additives. Examples of additives that may be used include antidegradants (specific examples include antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Specific examples of antioxidants include BHT (di(tert-butyl)p-cresol), hindered phenols, hindered amines, paraphenylenediamine, arylalkanes, hydroquinone, spirochromanes, spiroindanones, derivatives of any of the above compounds, organosulfur compounds, and organophosphorus compounds.

In order to improve charge stability of the photosensitive layer, the photosensitive layer preferably contains one or more compounds represented by formula (6) or (7). The compounds represented by the formula (6) or (7) are expected to function as a plasticizer. The formulae (6) and (7) are shown below in order, and the compound represented by each formula will be described in detail.

(6)

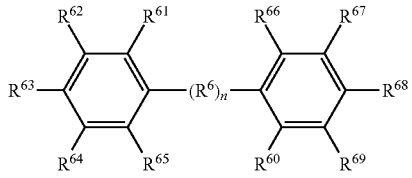

In the formula (6), $R^{61}$, $R^{62}$, $R^{63}$, $R^{64}$, $R^{65}$, $R^{66}$, $R^{67}$, $R^{68}$, $R^{69}$, and $R^{60}$ each represent, independently of one another, a chemical group selected from the group consisting of a hydrogen atom, a halogen atom, a hydroxyl group, a cyano group, a nitro group, an amino group, an optionally substituted straight-chain or branched alkyl group having a carbon number of no less than 1 and no greater than 12, an optionally substituted cycloalkyl group having a carbon number of no less than 3 and no greater than 12, an optionally substituted alkoxy group having a carbon number of no less than 1 and no greater than 12, an optionally substituted aryl group having a carbon number of no less than 6 and no greater than 30, an optionally substituted aralkyl group having a carbon number of no less than 7 and no greater than 30, and an optionally substituted heterocyclic group, $R^6$ represents an optionally substituted alkylene group having a carbon number of no less than 1 and no greater than 12, and n represents 0 or 1. $R^{61}$, $R^{62}$, $R^{63}$, $R^{64}$, $R^{65}$, $R^{66}$, $R^{67}$, $R^{68}$, $R^{69}$, and $R^{60}$ may be the same as or different from one another.

When at least one of $R^{60}$ to $R^{69}$ is a halogen atom in the formula (6), the halogen atom is particularly preferably fluorine, chlorine, bromine, or iodine. When at least one of $R^{60}$ to $R^{69}$ is an alkyl group in the formula (6), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, an n-decyl group, or an cyclohexyl group. When at least one of $R^{60}$ to $R^{69}$ is an alkoxy group in the formula (6), the alkoxy group is particularly preferably a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, an n-decyloxy group, a phenoxy group, a naphthyloxy group, an anthryloxy group, or a phenanthryloxy group. When at least one of $R^{60}$ to $R^{69}$ is an aryl group in the formula (6), the aryl group is particularly preferably a phenyl group, a naphthyl group, an anthryl group, or a phenanthryl group. When at least one of $R^{60}$ to $R^{69}$ is an aralkyl group in the formula (6), the aralkyl group is particularly preferably a benzyl group, a phenethyl group, an α-naphthylmethyl group, or a β-naphthylmethy group. When at least one of $R^{60}$ to $R^{69}$ is a heterocyclic group in the formula (6), the heterocyclic group is particularly preferably a pyridyl group. When $R^6$ is an alkylene group in the formula (6), the alkylene group is particularly preferably a methylene group, an ethylene group, an n-propylene group, a trimethylene group, an isopropylidene group, an n-butylene group, an n-hexylene group, an n-heptylene group, an n-octylene group, or an n-dodecylene group.

In order to improve charge stability of the photosensitive layer, it is particularly preferable that in the formula (6), $R^{60}$ to $R^{69}$ each represent, independently of one another, a hydrogen atom or a phenyl group. $R^6$ represents a methylene group, and n represents 0 or 1. Examples of the compounds represented by the formula (6) that may be favorably used include compounds (biphenyl derivatives) represented by any of formulae (6-1) to (6-3) shown below.

(6-1)

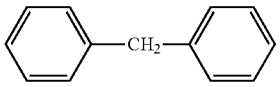

(6-2)

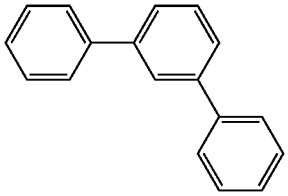

(6-3)

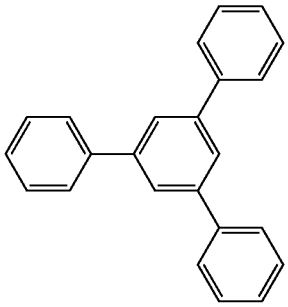

With respect to the formulae (6-1) to (6-3), $R^6$, $R^{60}$ to $R^{69}$, and n in the formula (6) are as follows.

(6-1)

$R^{60}$ to $R^{69}$: a hydrogen atom; n: 1, $R^6$: an alkylene group having a carbon number of 1 (methylene group)

(6-2)

$R^{60}$ to $R^{68}$: a hydrogen atom; $R^{69}$: a phenyl group; n: 0

(6-3)

$R^{60}$ to $R^{66}$ and $R^{68}$: a hydrogen atom; $R^{67}$ and $R^{69}$: a phenyl group; n: 0

(7)

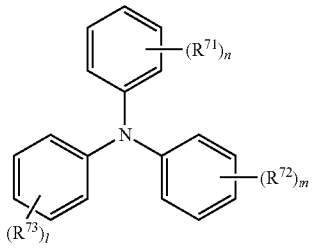

In the formula (7), $R^{71}$, $R^{72}$, and $R^{73}$ each represent, independently of one another, a chemical group selected from the group consisting of a halogen atom, an optionally substituted alkyl group having a carbon number of no less than 1 and no greater than 12, an optionally substituted alkoxy group having a carbon number of no less than 1 and no greater than 12, an optionally substituted aryl group having a carbon number of no less than 6 and no greater than 30, an optionally substituted aryloxy group having a carbon number of no less than 6 and no greater than 30, and n, m, and l each represent, independently of one another, an integer of no less than 0 and no greater than 5. $R^{71}$, $R^{72}$, and $R^{73}$ may be the same as or different from one another.

When at least one of $R^{71}$ to $R^{73}$ in the formula (7) is a halogen atom, the halogen atom is particularly preferably fluorine, chlorine, bromine, or iodine. When at least one of $R^{71}$ to $R^{73}$ is an alkyl group in the formula (7), the alkyl group is particularly preferably a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, or an n-decyl group. When at least one of $R^{71}$ to $R^{73}$ is an alkoxy group in the formula (7), the alkoxy group is particularly preferably a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, or an n-decyloxy group. When at least one of $R^{71}$ to $R^{73}$ is an aryl group in the formula (7), the aryl group is particularly preferably a phenyl group, a naphthyl group, an anthryl group, or a phenanthryl group. When at least one of $R^{71}$ to $R^{73}$ is an aryloxy group in the formula (7), the aryloxy group is particularly preferably a phenoxy group, a naphthyloxy group, an anthryloxy group, or a phenanthryloxy group.

In order to improve charge stability of the photosensitive layer, it is particularly preferable that in the formula (7), n, m, and l each represent, independently of one another, 1, and $R^{71}$ to $R^{73}$ each represent, independently of one another, a hydrogen atom or a methyl group. In order to improve charge stability of the photosensitive layer, it is particularly preferable that in the formula (7), n, m, and l each represent, independently of one another, 1, $R^{71}$ and $R^{72}$ each represent, independently of one another, a hydrogen atom, and $R^{73}$ is an alkyl group having a carbon number of no less than 1 and no greater than 6 (more preferably, a carbon number of no less than 1 and no greater than 4). Examples of the compounds represented by the formula (7) that may be favorably used include compounds (triphenylamine derivatives) represented by any of formulae (7-1) to (7-6) shown below.

(7-1)

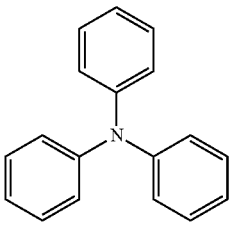

(7-2)

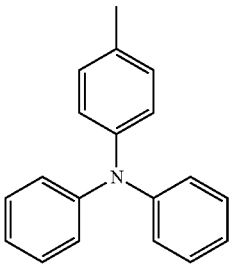

(7-3)

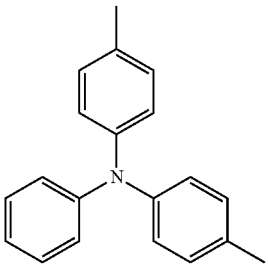

(7-4)

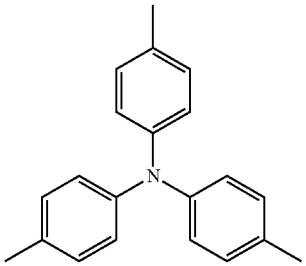

(7-5)

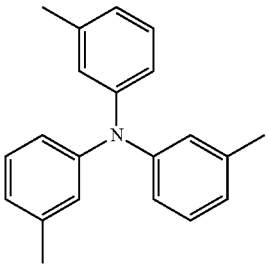

-continued (7-6)

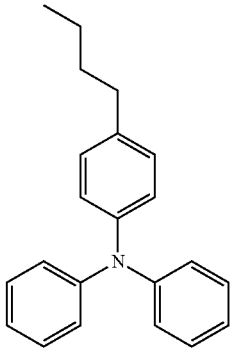

With respect to the formulae (7-1) to (7-6). $R^{71}$ to $R^{73}$, n, m, and l in the formula (7) are as follows.

(7-1)

n, m, and l: 0

(7-2)

n: 1; $R^{71}$: an alkyl group having a carbon number of 1 (methyl group); m and l: 0

(7-3)

n: 1, $R^{71}$: an alkyl group having a carbon number of 1 (methyl group); m: 1, $R^{72}$: an alkyl group having a carbon number of 1 (methyl group); 1:0

(7-4) and (7-5)

n: 1; $R^{71}$: an alkyl group having a carbon number of 1 (methyl group); m: 1, $R^{72}$: an alkyl group having a carbon number of 1 (methyl group); 1:1; $R^{73}$: an alkyl group having a carbon number of 1 (methyl group)

(7-6)

n: 1, $R^{71}$: a straight-chain alkyl group having a carbon number of 4 (normal butyl group); m and l: 0

Substituents of the chemical groups in the aforementioned formulae (for example, formulae (1) to (7), (HTM-1), and (Resin-1)) may be selected as appropriate, in accordance with for example an intended use of the photosensitive member, from the group consisting of a halogen atom (specific examples include fluorine, chlorine, bromine, and iodine), a nitro group, a cyano group, an amino group, a hydroxyl group, a carboxyl group, a sulfanyl group, a carbamoyl group, a straight-chain or branched alkyl group having a carbon number of at least 1 and no greater than 12, a cycloalkyl group having a carbon number of at least 3 and no greater than 12, an alkoxy group having a carbon number of at least 1 and no greater than 12, an alkylsulfanyl group having a carbon number of at least 1 and no greater than 12, an alkylsulfonyl group having a carbon number of at least 1 and no greater than 12, an alkanoyl group having a carbon number of at least 2 and no greater than 13, an alkoxycarbonyl group having a carbon number of at least 2 and no greater than 13, an aryl group having a carbon number of at least 6 and no greater than 14 (mono-cyclic, fused bi-cyclic, or fused tri-cyclic), and a heterocyclic group having no less than 6 and no greater than 14 ring members (mono-cyclic, fused bi-cyclic, or fused tri-cyclic). In a structure including a plurality of substituents, the substituents may be of the same type or of different types.

[Electrophotographic Photosensitive Member Manufacturing Method]

Hereinafter, an example of a method for manufacturing the electrophotographic photosensitive member having the above-described configuration according to the present embodiment will be described. For example, an application liquid preparation process, an application process, and a drying process are performed in the noted order. In the application liquid preparation process, at least a charge generating material, an electron transport material, a hole transport material, and a binder resin are added to a solvent to prepare an application liquid. An additive may be added to the solvent as necessary. In order to improve homogeneity of the application liquid for photosensitive layer formation, the materials added to the solvent are preferably dissolved or dispersed in the solvent. In the application process, the application liquid prepared in the application liquid preparation process is applied on to a conductive substrate. In the drying process, the application liquid on the conductive substrate is dried. As a result, an electrophotographic photosensitive member including the conductive substrate and a photosensitive layer formed on the conductive substrate is obtained.

The solvent that is used in the application liquid preparation process preferably contains at least one of tetrahydrofuran and toluene. The use of such a solvent tends to increase the degree of solubility or dispersibility of the charge generating material, the electron transport material, the hole transport material, and the binder resin in the application liquid. As a result, a homogeneous photosensitive layer is readily formed, making it easier to improve stability of charge potential of the resulting photosensitive member. As a result of the use of the solvent containing at least one of tetrahydrofuran and toluene in the application liquid preparation process, the photosensitive layer tends to contain at least one of tetrahydrofuran and toluene. Preferably, the amount of tetrahydrofuran or toluene in the photosensitive layer (the total amount of tetrahydrofuran and toluene in a situation in which the photosensitive layer contains both) is small (for example, a few ppm). The amount of tetrahydrofuran or toluene or the total amount of tetrahydrofuran and toluene contained in the photosensitive layer can be determined using a gas chromatograph mass spectrometer.

The solvent that is used in the application liquid preparation process is not limited to tetrahydrofuran and toluene, and any solvent may be used. Examples of solvents that may be used include alcohols (specific examples include methanol, ethanol, isopropanol, and butanol), aliphatic hydrocarbons (specific examples include n-hexane, octane, and cyclohexane), aromatic hydrocarbons (specific examples include benzene and xylene), halogenated hydrocarbons (specific examples include dichloromethane, dichloroethane, tetrachloromethane, and chlorobenzene), ethers (specific examples include dimethyl ether, diethyl ether, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, N,N-dimethyl formamide (DMF), and dimethyl sulfoxide. One solvent may be used independently, or two or more solvents may be used in a combination.

Examples of methods for dissolving or dispersing, in the solvent, the materials added to the solvent in the application liquid preparation process include a method in which the solvent is stirred using a bead mill, a roll mill, a ball mill, an attritor, a paint shaker or an ultrasound disperser; and a method in which a surfactant is added to the solvent. These two methods may be employed in a combination.

Examples of methods that can be used to apply the application liquid in the application process include dip coating, spray coating, spin coating, and bar coating.

Examples of methods for drying the application liquid in the drying process include heat treatment (hot-air drying) using a high-temperature dryer or a reduced pressure dryer. The heat treatment temperature is for example no less than 40° C. and no greater than 150° C., and the heat treatment time is for example no less than 3 minutes and no greater than 120 minutes.

The above-described electrophotographic photosensitive member manufacturing method may be modified as appropriate according to the desired configuration, properties, or the like of the photosensitive member. For example, the materials for forming the photosensitive layer may be added to the solvent as a single addition or may be divided up and added to the solvent as a plurality of additions. Non-essential processes may alternatively be omitted. For example, the application liquid preparation process may be omitted in a situation in which a commercially available application liquid is used. The electrophotographic photosensitive member manufacturing method may further include either or both of a process of forming an intermediate layer and a process of forming a protective layer as necessary.

[Image Forming Apparatus]

The electrophotographic photosensitive member of the present embodiment can for example be favorably used as an image bearing member of an image forming apparatus. The image forming apparatus may be a monochrome image forming apparatus or a color image forming apparatus. The image forming apparatus to which the electrophotographic photosensitive member of the present embodiment is applied may have a configuration without a static eliminating section by adopting a process without static elimination without the need of the static eliminating section. In the image forming apparatus that adopts a process without static elimination, a charger repeats charging of an image bearing member without static elimination. A photosensitive member in an image forming apparatus without a static eliminating section tends to decrease in charge potential. However, in the case of the photosensitive member of the present embodiment, charge potential thereof tends to have excellent stability even when the photosensitive member is charged repeatedly. Therefore, it is thought that as a result of the image forming apparatus including the electrophotographic photosensitive member of the present embodiment, it is possible to inhibit a reduction in charge potential of the photosensitive member in the image forming apparatus from occurring even in a configuration in which the image forming apparatus does not include a static eliminator. Alternatively, the image forming apparatus may include a static eliminator as necessary.

Hereinafter, an example of the image forming apparatus to which the electrophotographic photosensitive member of the present embodiment is applied will be described with reference to FIG. 6. An image forming apparatus illustrated in FIG. 6 includes image bearing members (photosensitive members 1), chargers (charging devices 27), light exposure sections (exposure devices 28), development sections (developing devices 29), and a transfer section (image forming section 9). Each charger charges a surface of the corresponding image bearing member. Each light exposure section exposes the surface of the corresponding charged image bearing member to light to form an electrostatic latent image on the surface of the image bearing member. Each development section develops the electrostatic latent image into a toner image. The transfer section transfers the toner images onto a transfer target from the image bearing members. In a situation in which the image forming apparatus adopts a process without static elimination, the chargers that have charged the respective image bearing members recharge the image bearing members without static elimination performed on the image bearing members after light exposure by the light exposure sections, development by the development sections, and transfer by the transfer section.

Figure 6:
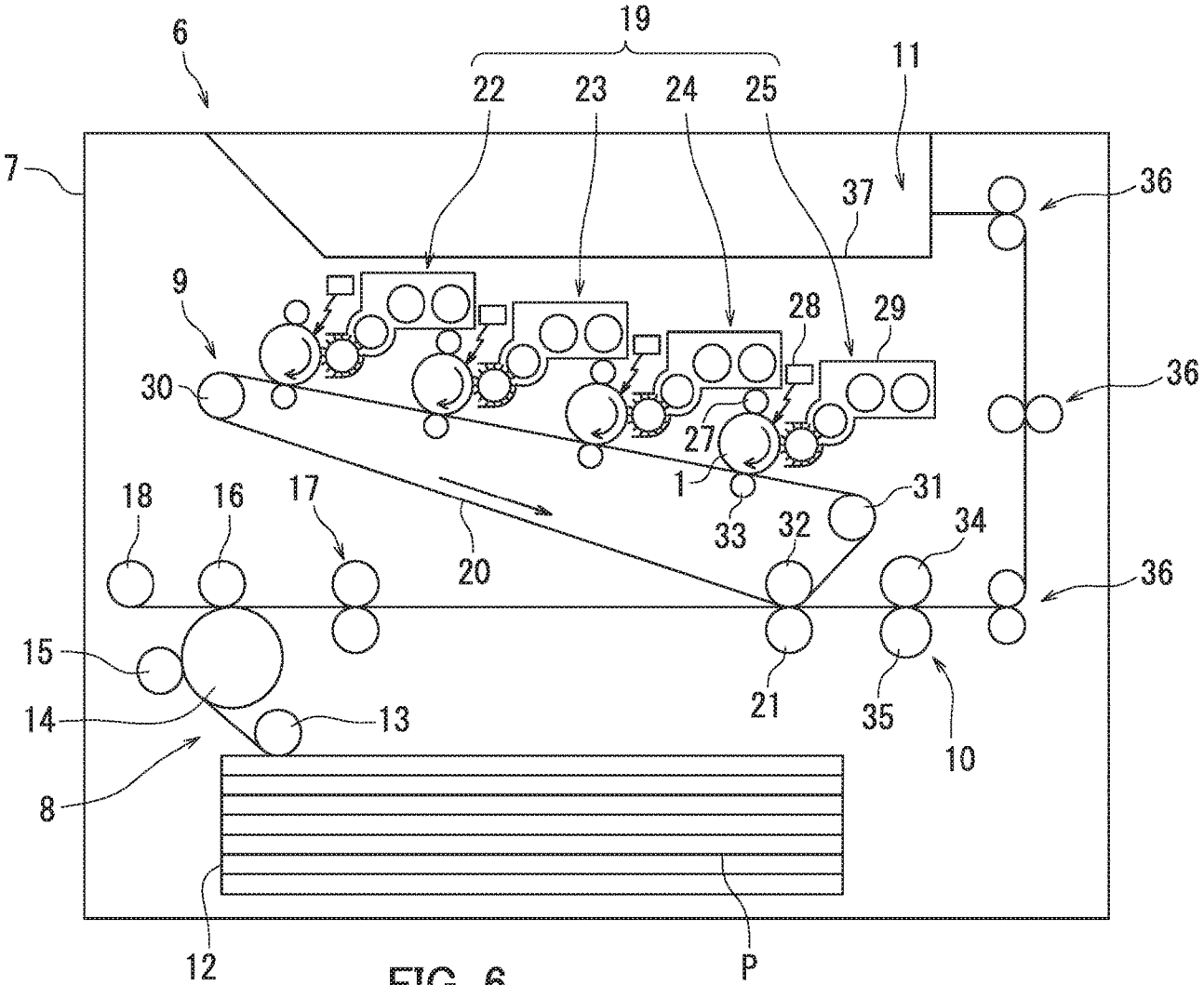
FIG. 6 is a diagram illustrating an overview of an image forming apparatus including the electrophotographic photosensitive member according to the embodiment of the present disclosure.

As illustrated in FIG. 6, the image forming apparatus 6 is a tandem color image forming apparatus. The image forming apparatus 6 has a box-type apparatus housing 7. The image forming apparatus 6 includes, in the apparatus housing 7, a paper feed section 8, the image forming section 9, a fixing section 10, conveyance rollers 36, and a paper ejection section 11. The image forming apparatus 6 may include a cleaning device as necessary.

The paper feed section 8 includes a paper feed cassette 12, a first pickup roller 13, paper feed rollers 14, 15, and 16, a pair of registration rollers 17, and a second pickup roller 18. The paper feed section 8 feeds paper P (printing paper) in the paper feed cassette 12 or paper (printing paper) placed on a manual feed tray, not shown, to the image forming section 9.

The image forming section 9 includes an image forming unit 19, an intermediate transfer belt 20, a secondary transfer roller 21, a drive roller 30, a driven roller 31, a backup roller 32, and a plurality of primary transfer rollers 33. The image forming section 9 forms toner images based on image data, transfers the toner images to the intermediate transfer belt 20 (primary transfer), and further transfers the toner images from the intermediate transfer belt 20 to paper p (secondary transfer). The intermediate transfer belt 20 is an endless circulating belt. The intermediate transfer belt 20 is wrapped against the drive roller 30, the driven roller 31, the backup roller 32, and the plurality of primary transfer rollers 33.

The image forming unit 19 includes a black toner supply unit 22, a cyan toner supply unit 23, a magenta toner supply unit 24, and a yellow toner supply unit 25. The units 25, 24, 23, and 22 are arranged in order from upstream (right side in FIG. 6) to downstream in a conveyance direction. The units 22, 23, 24, and 25 each include a photosensitive member 1 (electrophotographic photosensitive member of the present embodiment), a charging device 27, an exposure device 28, and a developing device 29.

The photosensitive member 1 is supported so as to be rotatable at a specific rotation speed (process speed) in an arrow direction illustrated in FIG. 6 (clockwise). Rotation of the photosensitive member 1 is for example controlled by a control section (for example, a computer), not shown. A process speed of the photosensitive member 1 of no less than 120 mm/s enables high-speed image formation and improved image formation efficiency. A high-speed process with a high process speed tends to result in photosensitive member deterioration that occurs more readily due to oxidizing gas (for example, ozone or $NO_x$) being produced. However, in the case of the electrophotographic photosensitive member of the present embodiment, charge potential of the photosensitive member tends to have excellent stability even when the photosensitive member is charged repeatedly. Therefore, it is thought that in a configuration in which the image forming apparatus includes the electrophotographic photosensitive member of the present embodiment, deterioration of the photosensitive member 1 can be inhibited even when the image forming apparatus has a process speed of no less than 120 mm/s. Alternatively, the process speed may be less than 120 mm/s as necessary.

The charging device 27 positively charges the surface of the photosensitive member 1 substantially uniformly. Preferable examples of the charging device 27 include a corona charging device, a charging roller, and a charging brush. In order to reduce the amount of gas (for example, oxidizing gas) that is generated from the charging device 27, the charging device 27 is preferably a contact charging device (for example, a charging roller or a charging brush), and is more preferably a charging roller. The charging roller is for example a charging roller that passively rotates in accordance with rotation of the photosensitive member 1 while in contact with the photosensitive member 1. In a preferable example, the charging roller is a charging roller that includes a metal core that is rotatably supported, a resin layer formed on the metal core, and a voltage applying section that applies voltage to the metal core. Preferable examples of the resin used to make the resin layer include silicone resins, urethane resins, and silicone modified resins. The resin layer may contain an inorganic material (for example, inorganic particles). Alternatively, a non-contact charging device 27 may be used as necessary.

In order to reduce abrasion of the photosensitive member 1, the charging device 27 preferably applies a direct current voltage to the photosensitive member 1. The charging device 27 preferably applies a direct current voltage of no less than 1,000 V and no greater than 2,000 V to the photosensitive member 1, more preferably applies a direct current voltage of no less than 1,200 V and no greater than 1,800 V, and particularly preferably applies a direct current voltage of no less than 1,400 V and no greater than 1,600 V. Alternatively, the charging device 27 may apply to the photosensitive member 1 an alternating current voltage or a composite voltage of an alternating current voltage superimposed on a direct current voltage.

The exposure device 28 exposes the surface of the charged photosensitive member 1 to light to form an electrostatic latent image on the surface of the photosensitive member 1. A laser scanning unit may be used as the exposure device 28.

The fixing section 10 includes a heating roller 34 and a pressure roller 35. The fixing section 10 fixes toner images transferred onto paper P.

The paper P having the toner images transferred thereon is ejected onto the paper ejection section 11. The paper ejection section 11 has an exit tray 37 that receives the paper P. The exit tray 37 is for example formed by a recess at the top of the apparatus housing 7.

The electrophotographic photosensitive member of the present embodiment may be included in a unitized configuration. More specifically, in addition to the photosensitive member, one or more selected from the group consisting of a charging section, a light exposure section, a development section, a transfer section, a cleaning section, and a static eliminating section may be included in a unitized configuration. Hereinafter, a cartridge that adopts such a unitized configuration including an electrophotographic photosensitive member is referred to as a process cartridge.

In order to improve serviceability of an image forming apparatus, a process cartridge including at least an electrophotographic photosensitive member is preferably attachable to and detachable from the image forming apparatus. When the photosensitive member deteriorates, the photosensitive member and other units can be easily and quickly replaced by replacing the process cartridge.

The image forming apparatus described above can form high quality images in a stable manner using the electrophotographic photosensitive member of the present embodiment.

EXAMPLES

Hereinafter, examples of the present disclosure will be described. Table 1 shows photosensitive members (electrophotographic photosensitive members) A-1 to A-8, B-1 to B-6, C-1 to C-2, D-1 to D-2, E-1 to E-6, F-1 to F-2, G-1 to G-3, H-1 to H-6, and I-1 to I-2 according to examples and comparative examples.

TABLE 1

| Photosensitive member | CGM | HTM | ETM Type | ETM Amount [Parts by weight] | Additive Type | Additive Amount [Parts by weight] |
|---|---|---|---|---|---|---|
| A-1 | x-$H_2Pc$ | HTM-A | 1-1/3-1 | 50/30 | | None |
| A-2 | | | 1-2/3-1 | | | |
| A-3 | | | 1-5/3-1 | | | |
| A-4 | | | 1-7/3-1 | | | |
| A-5 | | | 1-5/3-4 | | | |
| A-6 | | | 1-5/3-6 | | | |
| A-7 | | | 1-5/3-7 | | | |
| A-8 | | | 1-5/3-9 | | | |
| B-1 | x-$H_2Pc$ | HTM-A | 2-1/3-1 | 50/30 | | None |
| B-2 | | | 2-5/3-1 | | | |
| B-3 | | | 2-7/3-1 | | | |
| B-4 | | | 2-10/3-1 | | | |
| B-5 | | | 2-16/3-1 | | | |
| B-6 | | | 2-26/3-1 | | | |
| C-1 | x-$H_2Pc$ | HTM-A | 1-5/4-3 | 50/30 | | None |
| C-2 | | | 1-5/5-1 | | | |
| D-1 | x-$H_2Pc$ | HTM-A | 1-5/3-6 | 38/25 | | None |
| D-2 | | | | 75/40 | | |
| E-1 | x-$H_2Pc$ | HTM-A | 1-1/3-1 | 50/30 | 6-3 | 10 |
| E-2 | | | 1-5/3-6 | 50/30 | 6-2 | 10 |
| E-3 | | | | | 7-1 | 10 |
| E-4 | | | | | 7-4 | 10 |
| E-5 | | | | | 6-2 | 3 |
| E-6 | | | | | | 35 |
| F-1 | y-TiOPc (A) | HTM-A | 1-5/3-6 | 50/30 | | None |
| F-2 | y-TiOPc (C) | | | | | |
| G-1 | x-$H_2Pc$ | HTM-B | 1-5/3-6 | 50/30 | | None |
| G-2 | | HTM-C | | | | |
| G-3 | | HTM-D | | | | |
| H-1 | x-$H_2Pc$ | HTM-A | 1-2 | 65 | | None |
| H-2 | | | | 100 | | |
| H-3 | | | 2-2 | 65 | | |
| H-4 | | | 1-5/3-6 | 30/20 | | |
| H-5 | | | | 80/50 | | |
| H-6 | | | 3-1 | 65 | | |
| I-1 | x-$H_2Pc$ | HTM-A | 1-5/2-7/4-1 | 30/30/30 | | None |
| I-2 | x-$H_2Pc$ | HTM-A | 1-5/3-1/3-6 | 30/30/30 | | None |

In Table 1, "CGM" refers to charge generating material, "$H_2Pc$" refers to metal-free phthalocyanine represented by formula ($H_2Pc$), "TiOPc" refers to titanyl phthalocyanine represented by formula (TiOPc), and "x-" and "y-" each refer to crystal form (X-form, Y-form) of phthalocyanine. In Table 1, "y-TiOPc (A)" refers to Y-form titanyl phthalocyanine (A), and "v-TiOPc (C)" refers to Y-form titanyl phthalocyanine (C).

In Table 1, "ETM" refers to electron transport material. In Table 1, "Amount" of ETM and "Amount" of Additive refer to amount (parts by mass) of electron transport material and amount (parts by mass) of additive relative to 100 parts by mass of binder resin. In Table 1, "Type" of ETM and "Type" of Additive refer to the above-mentioned formulae. For example, "1-1" refers to the compound represented by the formula (1-1).

In Table 1, "HTM" refers to hole transport material. In Table 1, "HTM-A", "HTM-B", "HTM-C", and "HTM-D" refer to compounds represented by formula (HTM-A), formula (HTM-B), formula (HTM-C), and formula (HTM-D), respectively, shown below.

(HTM-A)

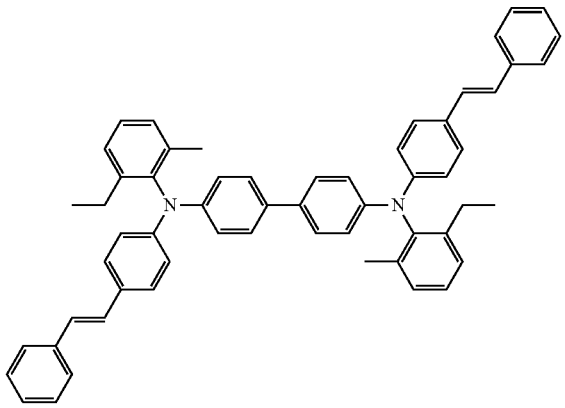

With respect to the formula (HTM-A), $Q^{31}$ to $Q^{38}$, n, m, and l in the formula (HTM-3) are as follows.

(HTM-A)

$Q^{31}$: a hydrogen atom; n: 0; $Q^{33}$: an alkyl group having a carbon number of 2 (ethyl group); $Q^{34}$ to $Q^{36}$: a hydrogen atom; $Q^{37}$: an alkyl group having a carbon number of 1 (methyl group); m and l: 0

(HTM-B)

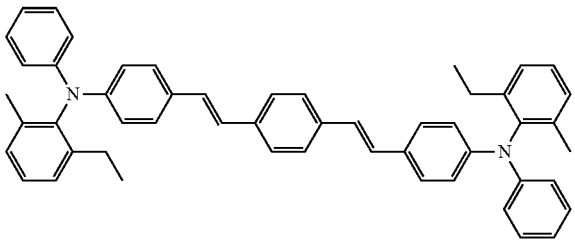

With respect to the formula (HTM-B), $Q^{411}$ to $Q^{415}$, $Q^{421}$ to $Q^{425}$, and $Q^{431}$ to $Q^{434}$ in the formula (HTM-4) are as follows.

(HTM-B)

$Q^{411}$: an alkyl group having a carbon number of 2 (ethyl group); $Q^{412}$ to $Q^{414}$: a hydrogen atom; $Q^{415}$: an alkyl group having a carbon number of 1 (methyl group); $Q^{421}$ to $Q^{425}$: a hydrogen atom; $Q^{431}$ to $Q^{434}$: a hydrogen atom (HTM-C)

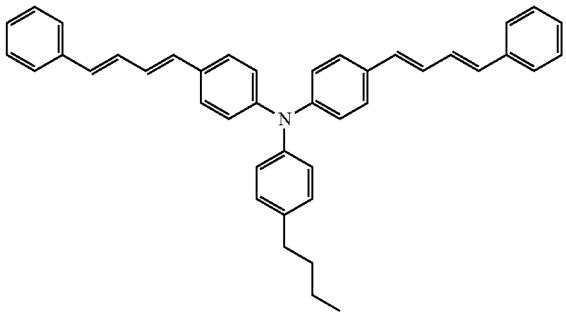

With respect to the formula (HTM-C), $Q^{22}$ to $Q^{27}$, a, and b in the formula (HTM-2) are as follows.

(HTM-C)

$Q^{23}$ and $Q^{24}$: a hydrogen atom; $Q^{25}$: a straight-chain alkyl group having a carbon number of 4 (normal butyl group), $Q^{26}$ and $Q^{27}$: a hydrogen atom; n: 0; a and b:2

(HTM-D)

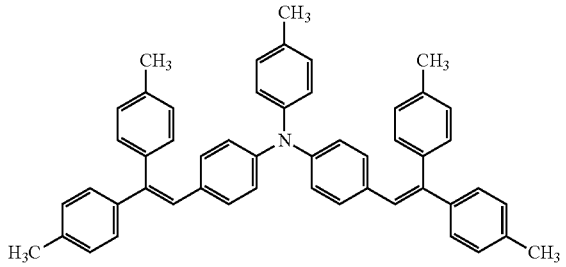

With respect to the formula (HTM-D), $Q^{11}$ to $Q^{15}$, n, and m in the formula (HTM-1) are as follows.

(HTM-D)

$Q^{11}$ to $Q^{15}$: an alkyl group having a carbon number of 1 (methyl group); n and m: 0

[Preparation of Photosensitive Member]

A ball mill vessel was charged with 100 parts by mass of a binder resin, 3 parts by mass of the charge generating material ("CGM" in Table 1), 60 parts by mass of the hole transport material ("HTM in Table 1), the electron transport material in the amount shown in Table 1 ("ETM" in Table 1), and 800 parts by mass of tetrahydrofuran. For preparing the photosensitive member A-1, for example, 100 parts by mass of a binder resin, 3 parts by mass of the charge generating material (x-$H_2$Pc), 60 parts by mass of the compound represented by the formula (HTM-A), 50 parts by mass of the compound represented by the formula (1-1), 30 parts by mass of the compound represented by the formula (3-1), and 800 parts by mass of tetrahydrofuran were added to the vessel. For preparing the photosensitive member H-1, 100 parts by mass of a binder resin, 3 parts by mass of the charge generating material (x-$H_2$Pc), 60 parts by mass of the compound represented by the formula (HTM-A), 65 parts by mass of the compound represented by the formula (1-2), and 800 parts by mass of tetrahydrofuran were added to the vessel. For preparing the photosensitive member I-1, 100 parts by mass of a binder resin, 3 parts by mass of the charge generating material (x-$H_2$Pc), 60 parts by mass of the compound represented by the formula (HTM-A), 30 parts by mass of the compound represented by the formula (1-5), 30 parts by mass of the compound represented by the formula (2-7), 30 parts by mass of the compound represented by the formula (4-1), and 800 parts by mass of tetrahydrofuran were added to the vessel. For preparing each of the photosensitive members E-1 to E-6, an additive was also added to the vessel (see Table 1). For preparing the photosensitive member E-1, for example, 10 parts by mass of the compound represented by the formula (6-3) was added as an additive to the vessel. A polycarbonate resin (viscosity average molecular weight: 30,000) having a repeating unit represented by formula (Resin-A) shown below was used as the binder resin.

(Resin-A)

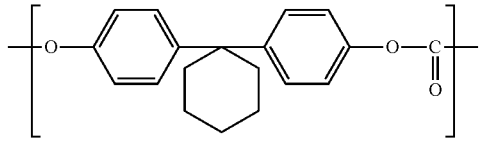

With respect to the formula (Resin-A), $Q^{51}$ and $Q^{52}$ in the formula (Resin-1) are as follows.

(Resin-A)

$Q^{51}$ and $Q^{52}$: a hydrogen atom

Next, the vessel contents were mixed for 50 hours using the ball mill to disperse the materials in tetrahydrofuran. As a result, an application liquid for photosensitive layer formation was obtained.

Next, the application liquid was applied onto a conductive substrate by dip coating. The conductive substrate was an aluminum drum-shaped support (diameter: 30 mm, length: 238.5 mm).

The applied application liquid (applied film) was heated for 60 minutes at 100° C. to remove tetrahydrofuran from the applied film. As a result, an electrophotographic photosensitive member including the conductive substrate and a single-layer type photosensitive layer having a thickness of 25 μm located directly on the conductive substrate was obtained.

[Evaluation Methods]

Samples (photosensitive members A-1 to A-8, B-1 to B-6, C-1 to C-2, D-1 to D-2, E-1 to E-6, F-1 to F-2. G-1 to G-3, H-1 to H-6, and I-1 to I-2) were evaluated according to the following methods.

(Ozone Resistance)

A sample (photosensitive member) was exposed to ozone and ozone resistance of the photosensitive member was evaluated based on a change ($\Delta V_1$) in charge potential of the sample before and after the exposure. A drum sensitivity test device (product of Gen-Tech, Inc.) was used as an evaluation device.

For evaluating ozone resistance of the photosensitive member, first, an initial charge test was performed in which the sample (photosensitive member) was placed in the evaluation device and rotated four times while being charged using the evaluation device in a standard temperature and humidity (temperature: 23° C., relative humidity: 50%) environment under conditions of a current of 8 μA (rotation speed: 31 rpm).

Surface potential of the sample was measured during the initial charge test. An average surface potential for the four rotations was taken to be an initial charge potential $V_{11}$ [V].

After the initial charge test, an ozone exposure test was performed in which the sample (photosensitive member) was left to stand in the dark for 6 hours in a standard temperature and humidity (temperature: 23° C., relative humidity: 50%) environment with an ozone concentration of 10 ppm. Surface potential of the sample immediately after the ozone exposure test was measured, and the measured surface potential was taken to be a post-exposure charge potential $V_{12}$ [V]. The post-exposure charge potential $V_{12}$ was measured under the same conditions for the initial charge potential $V_{11}$.

Next, based on the thus obtained initial charge potential $V_{11}$ and the thus obtained post-exposure charge potential $V_{12}$, a potential difference $\Delta V_1$ [V] was calculated in accordance with expression shown below.

$$\Delta V_1 = V_{11} - V_{12}$$

The ozone resistance of the sample (photosensitive member) was evaluated according to the following criteria (A, B, C, and D in order of decreasing ozone resistance).

A: $\Delta V_1$ of less than 30 V

B: $\Delta V_1$ of no less than 30 V and less than 40 V

C: $\Delta V_1$ of no less than 40 V and less than 50 V

D: $\Delta V_1$ of no less than 50 V (Repeated Use Resistance)

According to the following method, a durability test was performed on a sample (photosensitive member) in which the sample was subjected to alternately repeated charging and light exposure, and repeated use resistance of the photosensitive member was evaluated based on a change ($\Delta V_2$) in surface potential of the sample before and after the durability test. A drum sensitivity test device (product of Gen-Tech, Inc.) was used as an evaluation device.

For evaluating repeated use resistance of the photosensitive member, first, the sample (photosensitive member) was set in the evaluation device and charged to a surface potential of +700 V at a rotation speed of 100 rpm (process speed of 157 mm/s) using the evaluation device in a standard temperature and humidity (temperature: 23° C., relative humidity: 50%) environment.

Next, a band pass filter was used to obtain monochromatic light (wavelength: 780 nm, half-width: 20 nm) from light emitted by a halogen lamp and the surface of the sample (photosensitive member) charged as described above was irradiated with (exposed to) the obtained monochromatic light. The amount of the light was adjusted so that the surface potential for a first rotation after the start of the light exposure was 180 V. Subsequently, a durability test was performed in which 1,000 sets of alternate repetitions of charging and light exposure described above were carried out for one rotation each. Surface potential of the sample (photosensitive member) during the durability test was measured. An average surface potential (an average of surface potential values measured at a plurality of measurement positions) during charging of a 10th set was taken to be an initial charge potential $V_{21}$ [V]. An average surface potential (an average of surface potential values measured at a plurality of measurement positions) during charging of a 1000th set was taken to be a post-durability test charge potential $V_{22}$ [V]. Static elimination was not performed on the photosensitive member after the light exposure.

Next, based on the thus obtained initial charge potential $V_{21}$ and the thus obtained post-durability test charge potential $V_{22}$, a potential difference $\Delta V_2$ [V] was calculated in accordance with expression shown below.

$$\Delta V_2 = V_{21} - V_{22}$$

The repeated use resistance of the sample (photosensitive member) was evaluated according to the following criteria (A, B, C, and D in order of decreasing repeated use resistance).

A: $\Delta V_2$ of less than 30 V

B: $\Delta V_2$ of no less than 30 V and less than 40 V

C: $\Delta V_2$ of no less than 40 V and less than 50 V

D: $\Delta V_2$ of no less than 50 V

[Evaluation Results]

Table 2 shows evaluation results of the photosensitive members A-1 to A-8, B-1 to B-6, C-1 to C-2, D-1 to D-2, E-1 to E-6, F-1 to F-2, G-1 to G-3, H-1 to H-6, and I-1 to I-2.

TABLE 2

| | Photo-sensitive member | Ozone resistance | | Repeated use resistance | |
|---|---|---|---|---|---|
| | | $\Delta V_1$ [V] | Evaluation | $\Delta V_2$ [V] | Evaluation |
| Example 1 | A-1 | 38 | B | 33 | B |
| Example 2 | A-2 | 40 | C | 33 | B |
| Example 3 | A-3 | 38 | B | 30 | B |

TABLE 2-continued

| | Photo-sensitive member | Ozone resistance $\Delta V_1$ [V] | Ozone resistance Evaluation | Repeated use resistance $\Delta V_2$ [V] | Repeated use resistance Evaluation |
|---|---|---|---|---|---|
| Example 4 | A-4 | 35 | B | 34 | B |
| Example 5 | A-5 | 37 | B | 38 | B |
| Example 6 | A-6 | 36 | B | 31 | B |
| Example 7 | A-7 | 37 | B | 35 | B |
| Example 8 | A-8 | 40 | C | 36 | B |
| Example 9 | B-1 | 35 | B | 37 | B |
| Example 10 | B-2 | 33 | B | 37 | B |
| Example 11 | B-3 | 34 | B | 34 | B |
| Example 12 | B-4 | 31 | B | 33 | B |
| Example 13 | B-5 | 27 | A | 31 | B |
| Example 14 | B-6 | 31 | B | 33 | B |
| Example 15 | C-1 | 39 | B | 35 | B |
| Example 16 | C-2 | 38 | B | 33 | B |
| Example 17 | D-1 | 40 | C | 40 | C |
| Example 18 | D-2 | 43 | C | 26 | A |
| Example 19 | E-1 | 29 | A | 26 | A |
| Example 20 | E-2 | 28 | A | 25 | A |
| Example 21 | E-3 | 31 | B | 27 | A |
| Example 22 | E-4 | 22 | A | 24 | A |
| Example 23 | E-5 | 29 | A | 34 | B |
| Example 24 | E-6 | 23 | A | 42 | C |
| Example 25 | F-1 | 43 | C | 41 | C |
| Example 26 | F-2 | 34 | B | 28 | A |
| Example 27 | G-1 | 35 | B | 30 | B |
| Example 28 | G-2 | 33 | B | 27 | A |
| Example 29 | G-3 | 34 | B | 30 | B |
| Example 30 | I-1 | 31 | B | 29 | A |
| Example 31 | I-2 | 32 | B | 35 | B |
| Comparative Example 1 | H-1 | 58 | D | 64 | D |
| Comparative Example 2 | H-2 | — | — | — | Crystallization |
| Comparative Example 3 | H-3 | 52 | D | 69 | D |
| Comparative Example 4 | H-4 | 50 | D | 58 | D |
| Comparative Example 5 | H-5 | — | — | — | Crystallization |
| Comparative Example 6 | H-6 | — | — | — | Crystallization |

The photosensitive layers of the photosensitive members A-1 to A-8, B-1 to B-6, C-1 to C-2, D-1 to D-2, E-1 to E-6, F-1 to F-2. G-1 to G-3, and I-1 to I-2 (photosensitive members according to Examples 1 to 31) each contained phthalocyanine or a derivative thereof as a charge generating material. Furthermore, the electron materials in the photosensitive layers each contained at least one compound (ETM1) represented by the formula (1) or (2) and at least one compound (ETM2) represented by the formula (3), (4), or (5). The total amount of the ETM1 and the ETM2 was no less than 60 parts by mass and no greater than 120 parts by mass relative to 100 parts by mass of the binder resin in which the amount of the ETM1 is no less than 35 parts by mass and no greater than 80 parts by mass, and the amount of the ETM2 was no less than 25 parts by mass and no greater than 40 parts by mass. The photosensitive members according to Examples 1 to 31 were each excellent in ozone resistance and repeated use resistance.

What is claimed is:

1. An electrophotographic photosensitive member comprising:

a conductive substrate; and a photosensitive layer located either directly or indirectly on the conductive substrate, wherein the photosensitive layer is a single-layer type photosensitive layer containing at least a charge generating material, an electron transport material, a hole transport material, and a binder resin, the charge generating material includes X-form metal-free phthalocyanine, the electron transport material includes a first compound and a second compound, and a combination of the first compound and the second compound is any one combination selected from:

a combination in which the first compound is a compound represented by formula (1-5) shown below, and the second compound is a compound represented by any one of formulae (3-1), (3-7), and (4-3) shown below; and a combination in which the second compound is a compound represented by the formula (3-1), and the first compound is a compound represented by any one of formulae (1-1), (2-1), (2-5), (2-7), (2-10), (2-16), and (2-26) shown below, a total amount of the first compound and the second compound is no less than 60 parts by mass and no greater than 120 parts by mass relative to 100 parts by mass of the binder resin, an amount of the first compound is no less than 35 parts by mass and no greater than 80 parts by mass, and an amount of the second compound is no less than 25 parts by mass and no greater than 40 parts by mass, (1-5)

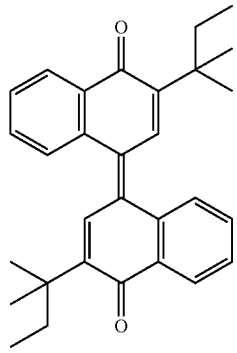

(3-1)

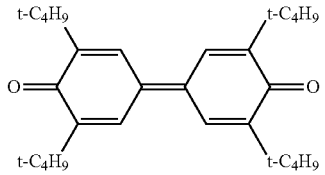

(3-7)

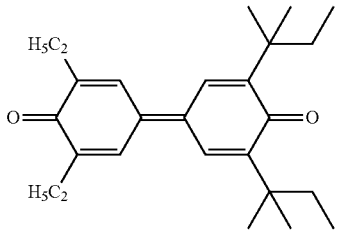

-continued (4-3)

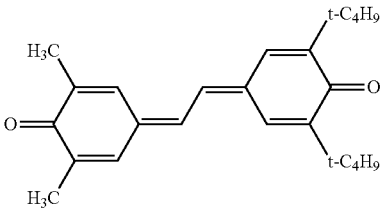

(1-1)

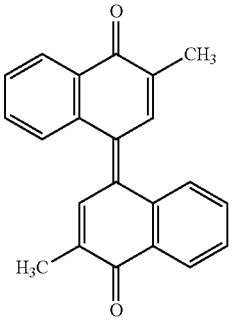

(2-1)

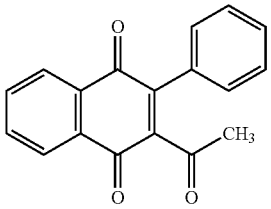

(2-5)

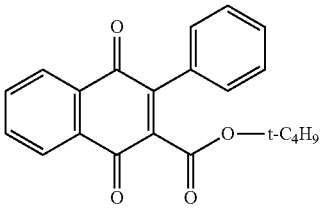

(2-7)

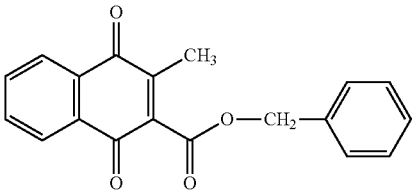

-continued (2-10)

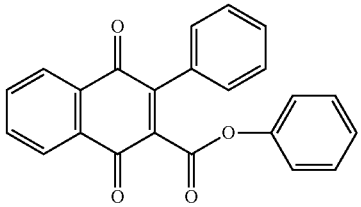

(2-16)

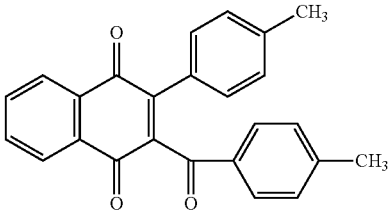

(2-26)

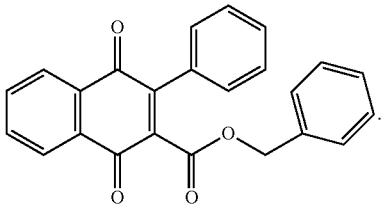

2. The electrophotographic photosensitive member according to claim 1, wherein the photosensitive layer contains a third compound represented by formula (6) or (7) shown below, (6)

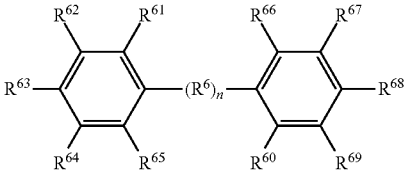

where, in the formula (6), $R^{61}$, $R^{62}$, $R^{63}$, $R^{64}$, $R^{65}$, $R^{66}$, $R^{67}$, $R^{68}$, $R^{69}$, and $R^{60}$ each represent, independently of one another, a chemical group selected from the group consisting of a hydrogen atom, a halogen atom, a hydroxyl group, a cyano group, a nitro group, an amino group, an optionally substituted alkyl group having a carbon number of no less than 1 and no greater than 12, an optionally substituted alkoxy group having a carbon number of no less than 1 and no greater than 12, an optionally substituted aryl group having a carbon number of no less than 6 and no greater than 30, an optionally substituted aralkyl group having a carbon number of no less than 7 and no greater than 30, an optionally substituted cycloalkyl group having a carbon number of no less than 3 and no greater than 12, and an optionally substituted heterocyclic group, $R^6$ represents an optionally substituted alkylene group having a carbon number of no less than 1 and no greater than 12, and n represents 0 or 1, (7)

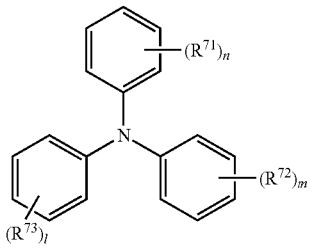

in the formula (7), $R^{71}$, $R^{72}$, and $R^{73}$ each represent, independently of one another, a chemical group selected from the group consisting of a halogen atom, an optionally substituted alkyl group having a carbon number of no less than 1 and no greater than 12, an optionally substituted alkoxy group having a carbon number of no less than 1 and no greater than 12 other than an aryloxy group, an optionally substituted aryl group having a carbon number of no less than 6 and no greater than 30, and an optionally substituted aryloxy group having a carbon number of no less than 6 and no greater than 30, and n, m, and l each represent, independently of one another, an integer of no less than 0 and no greater than 5.

3. The electrophotographic photosensitive member according to claim 2, wherein an amount of the third compound is no less than 0.1 parts by mass and no greater than 40 parts by mass relative to 100 parts by mass of the binder resin.

4. The electrophotographic photosensitive member according to claim 2, wherein the electron transport material includes the compound represented by the formula (1-1) and the compound represented by the formula (3-1), and the photosensitive layer contains a compound represented by formula (6-3) shown below as the third compound represented by the formula (6)

(6-3)

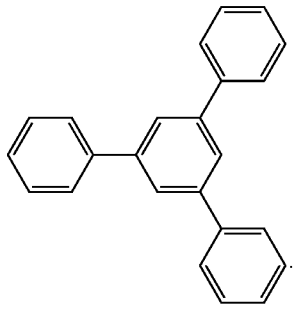

5. The electrophotographic photosensitive member according to claim 1, wherein the hole transport material includes a compound represented by formula (HTM-3) shown below, (HTM-3)

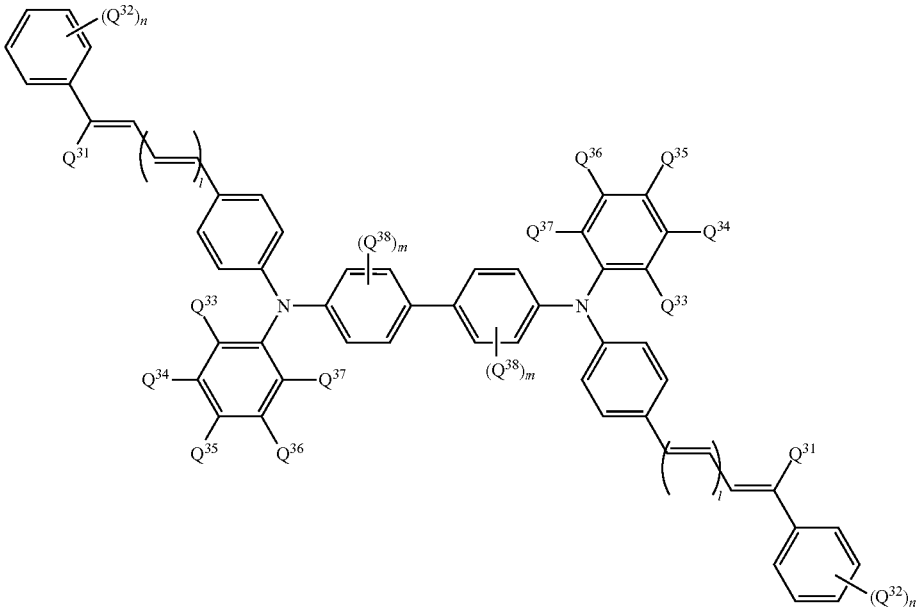

where in the formula (HTM-3), $Q^{31}$, $Q^{32}$, $Q^{33}$, $Q^{34}$, $Q^{35}$, $Q^{36}$, $Q^{37}$, and $Q^{38}$ each represent, independently of one another, a hydrogen atom, an alkyl group having a carbon number of no less than 1 and no greater than 8, an alkoxy group having a carbon number of no less than 1 and no greater than 8, or a phenyl group, n represents an integer of no less than 0 and no greater than 5, m represents an integer of no less than 0 and no greater than 4, l represents 0 or 1, and adjacent chemical groups among $Q^{33}$, $Q^{34}$, $Q^{35}$, $Q^{36}$, and $Q^{37}$ may be bonded to one another to form a ring.

6. The electrophotographic photosensitive member according to claim 1, wherein the photosensitive layer contains at least one of tetrahydrofuran and toluene.

7. An image forming apparatus comprising:

an image bearing member;

a charger;

a light exposure section;

a development section; and a transfer section, wherein the image bearing member includes the electrophotographic photosensitive member according to claim 1.

8. The image forming apparatus according to claim 7, wherein a process speed of the image bearing member is no less than 120 mm/s.

9. The image forming apparatus according to claim 7, wherein the charger repeats charging of the image bearing member without static elimination.

10. A process cartridge comprising the electrophotographic photosensitive member according to claim 1.

* * * * *